US008453840B2

(12) United States Patent
Wharton

(10) Patent No.: US 8,453,840 B2
(45) Date of Patent: Jun. 4, 2013

(54) PACKAGING

(75) Inventor: Burgo John Wharton, London (GB)

(73) Assignee: Duff Design Limited, London (GB)

( * ) Notice: Subject to any disclaimer, the term of this patent is extended or adjusted under 35 U.S.C. 154(b) by 0 days.

(21) Appl. No.: 12/673,829

(22) PCT Filed: Aug. 18, 2008

(86) PCT No.: PCT/GB2008/002801

§ 371 (c)(1),
(2), (4) Date: Mar. 12, 2010

(87) PCT Pub. No.: WO2009/024772

PCT Pub. Date: Feb. 26, 2009

(65) Prior Publication Data

US 2011/0036743 A1 Feb. 17, 2011

(30) Foreign Application Priority Data

Aug. 17, 2007 (GB) ..... 0716146.6

(51) Int. Cl.
*B65D 83/04* (2006.01)
*B65D 5/38* (2006.01)

(52) U.S. Cl.
USPC ..... 206/531; 206/1.5; 206/468

(58) Field of Classification Search
USPC ..... 206/531, 308.1, 1.5, 528, 540, 538, 206/536, 745, 468
See application file for complete search history.

(56) References Cited

U.S. PATENT DOCUMENTS

| | | | | | |
|---|---|---|---|---|---|
| 3,600,917 | A * | 8/1971 | Krock | 70/459 |
| 4,007,828 | A * | 2/1977 | Mayled | 206/1.5 |
| 4,076,117 | A * | 2/1978 | Wisdom et al. | 206/106 |
| 4,126,224 | A * | 11/1978 | Laauwe et al. | 206/540 |
| 4,561,544 | A * | 12/1985 | Reeve | 206/540 |
| 5,275,291 | A * | 1/1994 | Sledge | 206/531 |
| 6,047,829 | A * | 4/2000 | Johnstone et al. | 206/531 |
| 6,557,700 | B1 * | 5/2003 | Wharton | 206/308.1 |
| 6,848,577 | B2 * | 2/2005 | Kawamura et al. | 206/449 |
| 6,976,576 | B2 * | 12/2005 | Intini | 206/1.5 |

(Continued)

FOREIGN PATENT DOCUMENTS

| | | | |
|---|---|---|---|
| WO | 2005/102849 | A1 | 11/2005 |
| WO | WO 2005102849 | A1 * | 11/2005 |
| WO | 2007083151 | A1 | 7/2007 |

OTHER PUBLICATIONS

International Search Report, Application No. PCT/GB2008/002801, 4 pages, Oct. 13, 2008.

*Primary Examiner* — Steven A. Reynolds
(74) *Attorney, Agent, or Firm* — Dinsmore & Shohl LLP

(57) ABSTRACT

A child-resistant package includes a support for supporting hazardous material in use; a structure for selectively blocking access to hazardous material supported by the support, with the support being movable between a secured position in which access to the hazardous material is blocked and an access position in which the hazardous material is accessibly clear of the structure; at least one latch member movable between an engaged state and a disengaged state in which the support is allowed to move out of the secured position toward the access position; and a tab member movable with respect to the structure in a second direction different to the first direction, the tab member being coupled to the support to effect movement of the support out of the secured position in the first direction when the latch member is in the disengaged state.

27 Claims, 19 Drawing Sheets

U.S. PATENT DOCUMENTS

| | | | | |
|---|---|---|---|---|
| 7,389,875 | B2 * | 6/2008 | Sandberg et al. | 206/531 |
| 7,854,325 | B2 * | 12/2010 | Bentele | 206/531 |
| 8,066,121 | B2 * | 11/2011 | Sack et al. | 206/531 |
| 2002/0056652 | A1 * | 5/2002 | Kawamura et al. | 206/37 |
| 2004/0099565 | A1 * | 5/2004 | Dehlin et al. | 206/536 |
| 2009/0152134 | A1 * | 6/2009 | Katsis | 206/96 |
| 2009/0178948 | A1 * | 7/2009 | Reilley et al. | 206/531 |
| 2009/0184022 | A1 * | 7/2009 | Coe et al. | 206/531 |
| 2010/0230316 | A1 * | 9/2010 | Wharton | 206/462 |
| 2011/0068039 | A1 * | 3/2011 | Sack et al. | 206/531 |

* cited by examiner

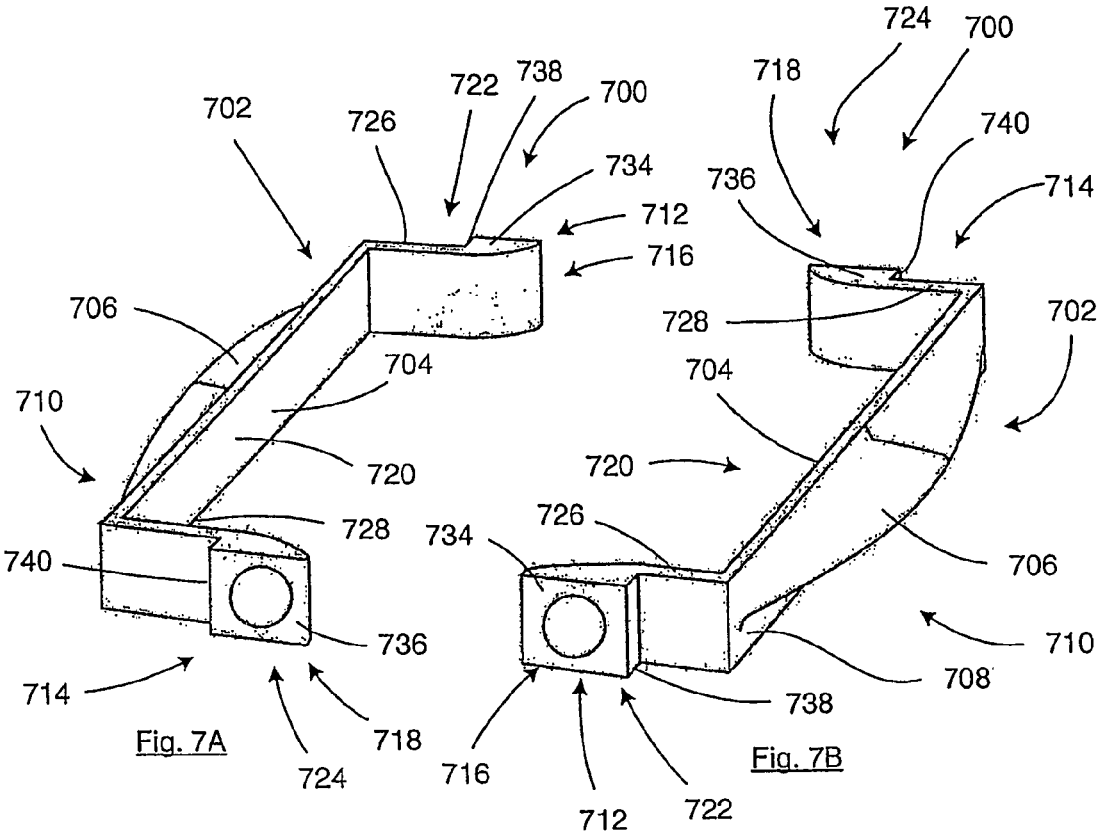
Fig. 7A
Fig. 7B
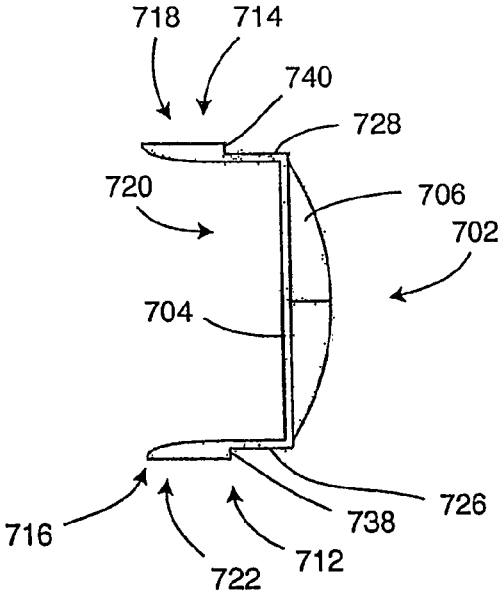
Fig. 7C
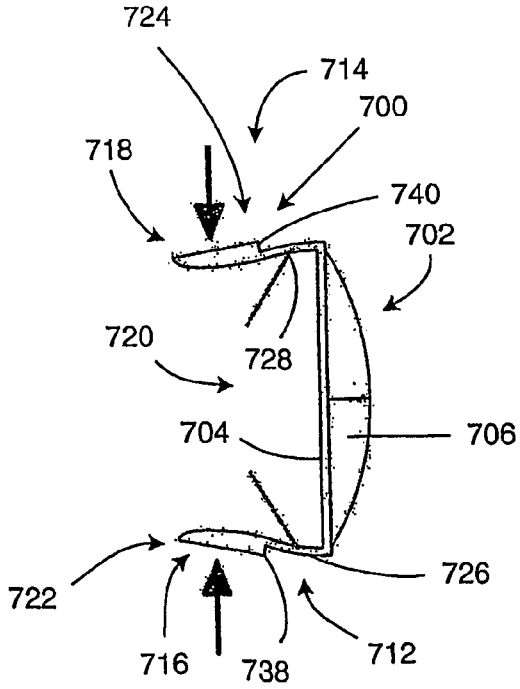
Fig. 7D

PACKAGING

This invention relates to packaging such as a box, which may be used in the packaging of items. In particular, though not exclusively, the invention relates to a child-resistant package for storing potentially hazardous materials such as, for example, pharmaceuticals or household chemicals, which must be kept safe from children or irresponsible adults.

The safe storage of potentially hazardous materials such as pharmaceuticals and household chemicals has long been a problem for families with young children. Whilst parents desire access to a wide range of pharmaceuticals in order to be able to treat illnesses promptly and easily, and require household chemicals for example to clean their home, the natural curiosity of children can cause them to seek out and ingest such materials when unsupervised. This can have serious consequences. For example, an overdose of virtually any pharmaceutical is injurious to health. Indeed some pharmaceuticals are entirely unsuitable for children and have an adverse effect on the health of children even if handled or ingested in very small quantities. Similar dangers arise from other, non-pharmaceutical materials, including household chemicals such as detergents and rat poison.

For the sake of simplicity, potentially hazardous materials such as those described above will hereinafter simply be referred to as "hazardous materials". Additionally, the problems described above are not limited to children and can also arise in respect of irresponsible or forgetful adults, such as for example some mentally ill or mentally disabled patients, or the elderly who may be prone to confusion as to the contents of a package. Whilst the focus of this specification is on children, it will be appreciated that the majority of what is described herein applies analogously to irresponsible or forgetful adults. All such analogies are within the scope of this specification, even where reference is made only to children.

In light of their dangerous nature, hazardous materials must be kept out of the reach of children. This is an established practice that is of fundamental importance and which may be augmented, but can never be replaced, by child resistant closures (CRCs). CRCs make it harder for children to extract hazardous materials from a package, if they do manage gain access to them in packaged form.

Many CRC designs have been suggested in the past. However, designers of CRCs must always work against the paradox that a package which is difficult for a child to open often also presents difficulties for adults. In fact, up to 90 percent of adults struggle to open CRCs, according to a 2004 report in the journal of the Engineering and Physical Sciences Research Council. The alarming consequence of this is that adults often decant hazardous materials into non-safe containers, a practice that is thought to contribute to a large proportion of accidental poisonings.

A further problem is that known CRCs are often complicated in structure, and expensive to manufacture. Since the cost of packaging is generally passed on to consumers, this leads consumers to buy products in non-resistant packaging where available, thereby increasing the risk of accidental poisonings and the like.

It is an object of this invention to solve or mitigate at least one problem associated with the prior art.

From a first aspect, the present invention broadly resides in a child-resistant package, comprising:

a support for supporting hazardous material in use;

a structure for selectively blocking access to hazardous material supported by the support, the support being movable in a first direction with respect to the structure between a secured position in which access to the hazardous material is blocked by the structure and an access position in which the hazardous material is accessibly clear of the structure;

at least one latch member movable by a user between an engaged state in which the support is prevented from moving out of the secured position and a disengaged state in which the support is allowed to move out of the secured position toward the access position; and a tab member movable by the user with respect to the structure in a second direction different to the first direction, the tab member being coupled to the support to effect movement of the support out of the secured position in the first direction when the latch member is in the disengaged state.

The package according to the first aspect of the invention provides effective child resistance. Specifically, it enables an opening sequence in which two simultaneous actions, namely (i) disengagement of the latch member and (ii) movement of the tab member in the second direction, are necessary to gain access to the support. The latch member and the tab member act in synergy to provide child resistance, particularly since the tab member, which is coupled to the support, is movable in a second direction that is (surprisingly) different to the first direction of movement of the support.

To provide a particularly high level of child resistance, the package may preferably be adapted for two-handed operation by a user, wherein the tab member is movable by one hand of the user when the latch member has been moved into the disengaged state by the user's other hand. Whilst this two-handed operation is relatively easy for the elderly or infirm, it is difficult for children: it requires an appreciation of the surprising coupling of the tab member to the support. Therefore, the paradox traditionally faced by designers of CRCs is addressed.

Advantageously, to maximise the surprise associated with the difference between the first and second directions, the first and second directions may be mutually opposed.

Preferably, the tab member may be movable away from the structure to effect movement of the support away from the structure. For instance, the structure may advantageously define opposed sides and the tab member may be movable away from one side of the structure to cause the support to move away from the opposite side of the structure. This arrangement makes operation of the package more surprising by helping to maximise the distance between the tab member and the support, thereby enhancing child resistance.

Conveniently, the package may comprise first and second latch members, each latch member being movable by a user between an engaged state in which the support is prevented from moving out of the secured position and a disengaged state in which the support is allowed to move out of the secured position toward the access position. A greater number of latch members leads to greater child resistance. The inventors have found that two latch members represent an optimum compromise between child resistance and accessibility for the elderly and infirm. However, the invention is not limited to any particular number of latch members.

Advantageously, the first and second latch members may be adapted to be movable from their engaged state into their disengaged state in a squeezing action between thumb and forefinger of a user. When adapted in this way, the first and second latch members act in synergy, delivering more child resistance together than the sum of their parts. Specifically, a squeezing action between thumb and forefinger represents a hurdle for children on account of their smaller hands, whilst adults find disengagement relatively easy. The squeezing action is particularly effective in combination with the surprise associated with the coupling of the tab member to the support.

For ease and economy of manufacture, the first and second latch members may be integral with each other. The first and second latch members may for instance be carried on a single moulded plastics component such as a storage tray or a safety clip.

The or each latch member may advantageously comprise a live hinge to minimise the number of parts in the package.

The or each latch member may be to one side of the structure, opposed to a grip of the tab member. Child resistance is directly proportional to the distance between the grip of the tab member and the or each latch member. Thus, providing the or each latch member and the grip at opposite sides of the structure maximises this aspect of child resistance.

Advantageously, the or each latch member may be resiliently biased into the engaged state.

To provide a convenient interface for users, the or each latch member may comprise a button formation shaped to be pressured by a finger of a user.

Preferably, the or each latch member may comprise a shoulder for engaging the structure of the package in the engaged state.

The or each latch member may advantageously act between the support and the structure. Conveniently, the or each latch member may be carried by the support, and may optionally protrude beyond an outer wall of the support in the engaged state. Additionally or alternatively, to allow the support to move out of the secured position, the or each latch member may optionally lie substantially flush with the outer wall and be accommodated within the support in the disengaged state.

Preferably, the or each latch member may comprise a spring arm that is integral with the support. This represents a particularly convenient and cost-effective solution.

As an alternative to acting between the support and the structure, the or each latch member may act between the support and a barrier member that is movably or removably attached to the structure in the engaged state to block movement of the support into the access position. The or each latch member may then advantageously be carried by the barrier member. Advantageously, the or each latch member may be arranged such that the barrier member is engagable in a snap fit with the structure.

Conveniently, the or each latch member may protrude beyond a central panel of the barrier member in the engaged state. The central panel may advantageously define the maximum width of the barrier member when the or each latch member is in the disengaged state.

The surprising coupling of the tab member to the support may preferably be effected by a belt member extending around a divider of the structure. The belt member and the divider may contribute to the child resistance of the package in synergy with the latch members. Specifically, the or each latch member may advantageously prevent movement of the support out of the secured position in the first direction in the engaged state whilst the belt member and the divider may prevent movement of the support out of the secured position in the second direction.

The tab member of the package may take a variety of forms. It may comprise a simple cardboard panel or, advantageously, a storage means. To aid movement in the first direction, the tab member may preferably comprise a grip formation such as a finger hole, which improves access to the package for the elderly and infirm.

The support of the package may comprise a blister-pack or, preferably, a storage tray supporting a blister-pack. The or each latch member may be integrally moulded with the storage tray, or another type of support.

From a second aspect, the invention broadly resides in a storage tray comprising: a carriage having at least one latch member, the latch member being movable between an engaged state and a disengaged state; and a blister-pack attached to the carriage, the blister pack comprising one or more blisters, wherein the carriage is arranged to allow access to the or each blister of the attached blister-pack.

The storage tray according to the second aspect of the invention represents an advantageous and cost-effective solution for holding hazardous materials in a child resistant package. It enables both child resistant storage of hazardous materials stored within the blister-pack, on account of the at least one latch member, and easy access to the hazardous materials when required, without detachment of the blister-pack from the child resistant package.

Advantageously, the carriage may comprise a frame for supporting the blister-pack and a central opening within the frame to allow access to the or each blister of the blister-pack. A frame comprising a central opening provides maximum support for the blister-pack without affecting accessibility.

Preferably, the carriage may comprise: first and second walls; and first and second latch members integral with the first and second walls respectively, each latch member being movable between an engaged state and a disengaged state. Integral latch members facilitate cost effective manufacturing of the storage tray. Further, a greater number of latch members leads to greater child resistance. The inventors have found that two latch members represent an optimum compromise between child resistance and accessibility for the elderly and infirm. However, the invention is not limited to any particular number of latch members.

To enable the storage tray to be stored in a particularly child resistant manner, the first and second latch members may project beyond their respective walls in their engaged state to form respective protrusions. Additionally or alternatively, the first and second latch members may preferably lie substantially flush with their respective walls in their disengaged state.

From a third aspect, the present invention broadly resides in a carriage for a blister-pack, the carriage comprising: a frame for supporting a blister-pack having one or more blisters; and at least one latch member integral with the frame, the latch member being movable between an engaged state and a disengaged state; wherein the frame is arranged to allow access to the or each blister of a blister-pack supported by the frame in use.

The advantages of the storage tray according to the second aspect of the invention apply mutatis mutandis to the carriage of the third aspect of the invention.

From a fourth aspect, the invention broadly resides in a child-resistant package, comprising:

a support for supporting hazardous material in use;

a structure for selectively blocking access to hazardous material supported by the support, the support being movable in a first direction with respect to the structure between a secured position in which access to the hazardous material is blocked by the structure and an access position in which the hazardous material is accessibly clear of the structure;

at least one latch member movable by a user between an engaged state in which the support is prevented from moving out of the secured position and a disengaged state in which the support is allowed to move out of the secured position toward the access position; and at least one concealing cover co-operable with an associated latch member in the secured position for movement of the associated latch member between the engaged state and the disengaged state.

The package according to the fourth aspect of the invention provides child resistance by virtue of the concealing cover(s). To move the support out of the secured position, users must first have an understanding that the or each concealing cover is co-operable with an associated latch member to move the latch member into the disengaged state, which is in turn necessary to move the support towards the access position. This understanding is likely to be absent in children.

The or each concealing cover may preferable be flexible, and co-operation with the associated latch member may conveniently comprise elastic deformation of the concealing cover. This represents a particularly simple and effective way of ensuring co-operation between the concealing cover and the latch member.

To help address the paradox that a package which is difficult to open for a child often also presents difficulties for adults, the or each concealing cover may comprise a marking for indicating a location of the associated latch member. The marking may, for example, comprise a letter which may optionally be combined with written instructions on how to move the latch members into the disengaged state, printed, for example, onto the structure. Thus it is possible for the or each concealing cover to conceal an associated latch member whilst still providing an indication of where the latch member is. Also, more generally, the or each concealing covers need not conceal its associated latch member completely and could, for example, conceal the latch member only partly.

The or each concealing cover may optionally be supported by the structure. Preferably, the or each concealing cover may lie substantially flush with an outer surface of the structure.

For ease of manufacture, the or each concealing cover may be integral with the structure. Conveniently, the or each concealing cover may be integral with an outer wall of the structure, and the structure may comprise an inner wall having a catch formation for co-operating with an associated latch member of the support in the engaged state. The outer wall of the structure may preferably overlie the inner wall of the structure. The catch formation may optionally comprise an aperture in the inner wall.

Advantageously, the outer wall and the inner wall of the structure may be integral. For example, the structure may preferably comprise a sleeve formed from a folded blank and the outer and inner walls may be defined by fold lines of the blank. This allows a particularly efficient manufacture of the package.

The or each concealing cover may suitably be comprised of cardboard. Preferably, each latch member may comprise an associated concealing cover.

To enhance child resistance, the package may advantageously be adapted for two-handed operation by a user, with the support being movable by one hand of the user when the or each latch member has been moved into the disengaged state by the user's other hand.

Conveniently, the package may comprise first and second latch members, each latch member being movable by a user between an engaged state in which the support is prevented from moving out of the secured position and a disengaged state in which the support is allowed to move out of the secured position toward the access position. A greater number of latch members leads to greater child resistance. The inventors have found that two latch members represent an optimum compromise between child resistance and accessibility for the elderly and infirm. However, the invention is not limited to any particular number of latch members.

Advantageously, the first and second latch members may be adapted to be movable from their engaged state into their disengaged state in a squeezing action between thumb and forefinger of a user. When adapted in this way, the first and second latch members act in synergy, delivering more child resistance together than the sum of their parts. Specifically, a squeezing action between thumb and forefinger represents a hurdle for children on account of their smaller hands, whilst adults find disengagement relatively easy. The squeezing action is particularly effective in combination with the concealing effect of the concealing cover(s).

For ease and economy of manufacture, the first and second latch members may be integral with each other. The first and second latch members may for instance be carried on a single moulded plastics component such as a storage tray, a safety clip or a tab member.

Preferably, the or each latch member may be resiliently biased into the engaged state. Additionally or alternatively, the or each latch member may optionally comprise: a live hinge; and/or a ramp for guiding the or each latch member into the disengaged state; and/or a shoulder for engaging the structure of the package in the engaged state.

The or each latch member may optionally act between the support and the structure. Conveniently, the or each latch member may be carried by the support, and may optionally protrude beyond an outer wall of the support in the engaged state. Additionally or alternatively, to allow the support to move out of the secured position, the or each latch member may optionally lie substantially flush with the outer wall and be accommodated within the support in the disengaged state.

Preferably, the or each latch member may comprise a spring arm that is integral with the support. This represents a particularly convenient and cost-effective solution.

As an alternative to acting between the support and the structure, the or each latch member may act between the support and a barrier member that is movably or removably attached to the structure in the engaged state to block movement of the support into the access position. The or each latch member may then advantageously be carried by the barrier member. Advantageously, the or each latch member may be arranged such that the barrier member is engagable in a snap fit with the structure.

Conveniently, the or each latch member may protrude beyond a central panel of the barrier member in the engaged state. The central panel may advantageously define the maximum width of the barrier member when the or each latch member is in the disengaged state.

The support of the package may comprise a blister-pack or, preferably, a storage tray supporting a blister-pack. As aforesaid, the or each latch member may be integrally moulded with the storage tray, or another type of support.

To provide particularly high child resistance, the package may preferably further comprise a tab member movable by the user with respect to the structure in a second direction different to the first direction, the tab member being coupled to the support to effect movement of the support out of the secured position in the first direction when the or each latch member is in the disengaged state.

The presence of a tab member further enhances child resistance. Specifically, it enables an opening sequence in which two simultaneous actions, namely (i) disengagement of the latch member and (ii) movement of the tab member in the second direction, are necessary to gain access to the support. The latch member, the concealing cover, and the tab member act in synergy to provide child resistance, particularly since the tab member, which is coupled to the support, is movable in a second direction that is (surprisingly) different to the first direction of movement of the support.

Where a tab member is present, the package may advantageously be adapted for two-handed operation by a user, with the tab member being movable by one hand of the user when the latch member has been moved into the disengaged state by the user's other hand. Whilst this two-handed operation is relatively easy for the elderly or infirm, it is difficult for children: it requires an appreciation of the surprising coupling of the tab member to the support. Therefore, the paradox traditionally faced by designers of CRCs is addressed.

Advantageously, to maximise the surprise associated with the difference between the first and second directions, the first and second directions may be mutually opposed.

Preferably, the tab member may be movable away from the structure to effect movement of the support away from the structure. For instance, the structure may advantageously define opposed sides and the tab member may be movable away from one side of the structure to cause the support to move away from the opposite side of the structure. This arrangement makes operation of the package more surprising by helping to maximise the distance between the tab member and the support, thereby enhancing child resistance.

The or each latch member may be to one side of the structure, opposed to a grip of the tab member. Child resistance is directly proportional to the distance between the grip of the tab member and the or each latch member. Thus, providing the or each latch member and the grip at opposite sides of the structure maximises this aspect of child resistance. To facilitate operation of the package by the elderly or infirm, the grip may comprise a finger hole or finger well.

Advantageously, in order to double the storage capacity of the package, the tab member may comprise a storage means such as a support for a blister pack.

More generally, the tab member may preferably be coupled to the support by a belt member, the belt member extending around a divider of the structure.

The belt member and the divider may contribute to the child resistance of the package in synergy with the cover(s) and latch member(s). Specifically, the or each latch member may advantageously prevent movement of the support out of the secured position in the first direction in the engaged state whilst the belt member and the divider may prevent movement of the support out of the secured position in the second direction.

Other advantages of the invention will be apparent to the skilled person from the following description.

In order that this invention may be more readily understood, reference will now be made, by way of example, to the accompanying drawings in which:

FIGS. 7A and 7B are perspective views of a safety clip of the package according to the second embodiment of the invention in an engaged state;

FIG. 7C is a plan view of the safety clip of FIGS. 7A and 7B with latch members in an engaged state;

FIG. 7D is a plan view of the safety clip of FIGS. 7A to 7C with latch members in a disengaged state;

Figure 1A:
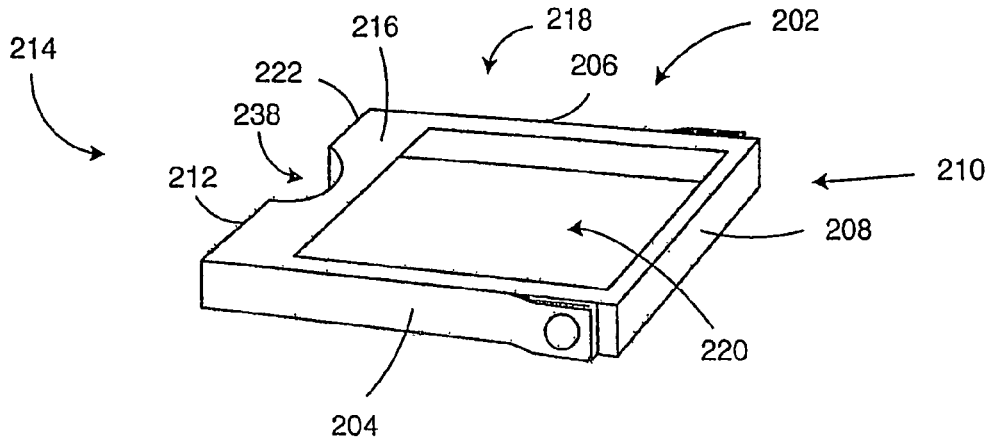
FIG. 1A is a perspective view of a frame of a storage tray of a package according to a first embodiment of the invention.

Referring to FIGS. 1 to 5, in a first embodiment of the invention a child resistant package 100 comprises: a support in the form of a storage tray 200 for storing hazardous materials (not shown), a structure, in the form of a sleeve 300 for blocking access to the hazardous materials, and a tab member 400 for actuating the storage tray 200. The package 100 comprises a rear end 102, a front end 104, a left side 106, a right side 108, an upper side 110, and a lower side 112.

With reference to FIG. 1A, the storage tray 200 comprises a generally oblong moulded plastics frame 202. The plastics frame 202 has left and right lateral walls 204, 206, a front wall 208 at a front end 210, a rear wall 212 at a rear end 214, and a flange 216 that projects inwards from the walls 204, 206, 208, 212 at an upper side 218 of the frame 202. In other words, the frame 202 is an inverted pan, comprising a central opening 220 defined by the flange 216, with the lateral, front and rear walls 204, 206, 208, 212 projecting downwards like a skirt from an outer rim 222 of the flange 216.

Figure 1B:
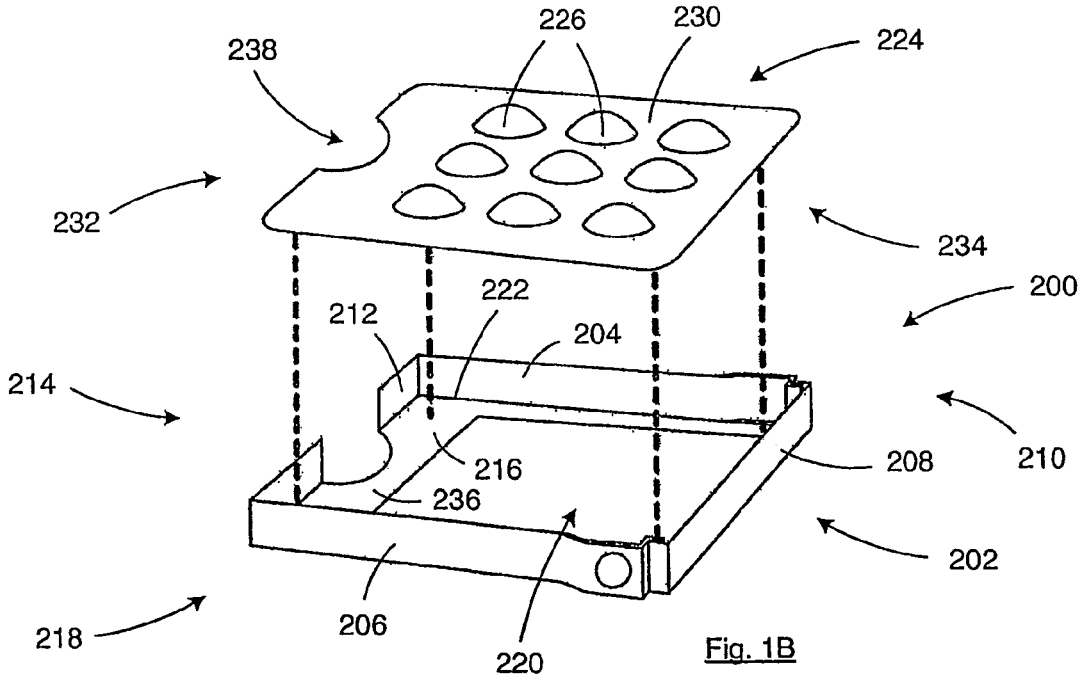
FIG. 1B is an exploded perspective view of the storage tray of the first embodiment of the invention comprising the frame of FIG. 1A and a blister-pack.
Figure 1C:
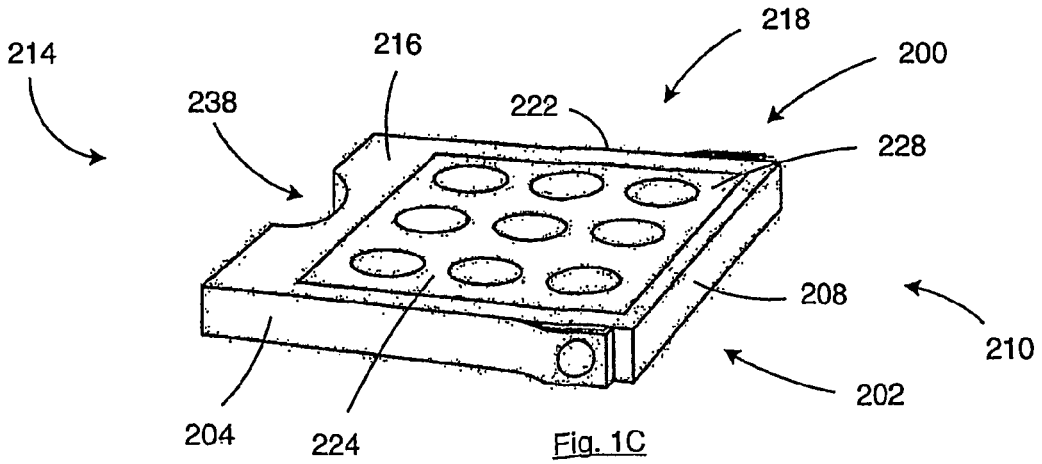
FIG. 1C is a perspective view of the storage tray of FIG. 1B, with the blister-pack assembled to the frame.

As illustrated by FIGS. 1B and 1C, the frame 202 serves to support a generally oblong blister-pack 224 of the storage tray 200. The blister-pack 224 provides storage for hazardous materials within a plurality of blisters 226 in conventional fashion and comprises an upper, foil-covered side 228, a lower blistered side 230, a rear end 232 and a front end 234. The upper side 228 of the blister-pack 224 is bonded to a lower side 236 of the flange 216 such that the blister-pack 224 is encased by the frame 202, with the blisters 226 of the blister-pack 224 projecting downwards. The content of a blister 226 may be accessed in conventional fashion by pressing it upwards, through the central opening 220 of the flange 216, to rupture the foil covering of the upper side 228 of the blister-pack 224.

The frame 202 and the blister-pack 224 each comprise a curved indentation 238 at their respective rear ends 214, 232. These indentations 238 are aligned when the blister-pack 224 is bonded to the frame 202 so that the assembled storage tray 200 as a whole has a curved indentation 238 at its rear end.

Referring now also to FIGS. 2A to 2D, the frame 202 of the storage tray 200 comprises left and right latch members 240, 242. The left latch member 240 comprises a spring arm section 244 of the left wall 204 of the frame 202, whilst the right latch member 242 comprises a spring arm section 246 of the right wall 206 of the frame 202. The latch members 240, 242 are naturally and resiliently biased outwards, to project laterally beyond respective remaining rear and front sections 248, 250, 252, 254 of the left and right walls 204, 206.

The frame 202 of the storage tray 200 is symmetrical about a central longitudinal axis (not shown). Therefore, the left and right latch members 240, 242 are mirror images of each other and function identically. Starting from rear to front, each latch member 240, 242 comprises: a live hinge 256, 258 contiguous with a rear remaining section 248, 250 of an associated lateral wall 204, 206; a button 260, 262 contiguous with the hinge 256, 258 having a panel 264, 266 and an orthogonal shoulder 268, 270; and a catch 272, 274 projecting orthogonally from the shoulder 268, 270 towards the front end 104 of the package 100. All components of the latch members 240, 242 are moulded integrally with the frame 202 of the storage tray 200.

Each latch member 240, 242 is resiliently movable between an engaged state and a disengaged state. Details of the engaged and disengaged states of the left latch member 240 will now be described with reference to FIGS. 2C and 2D. However, the skilled reader will appreciate that since the left and right latch 240, 242 members function identically, the description of the engaged and disengaged states of the left latch member 240 is also relevant to the right latch member 242.

Figure 2A:
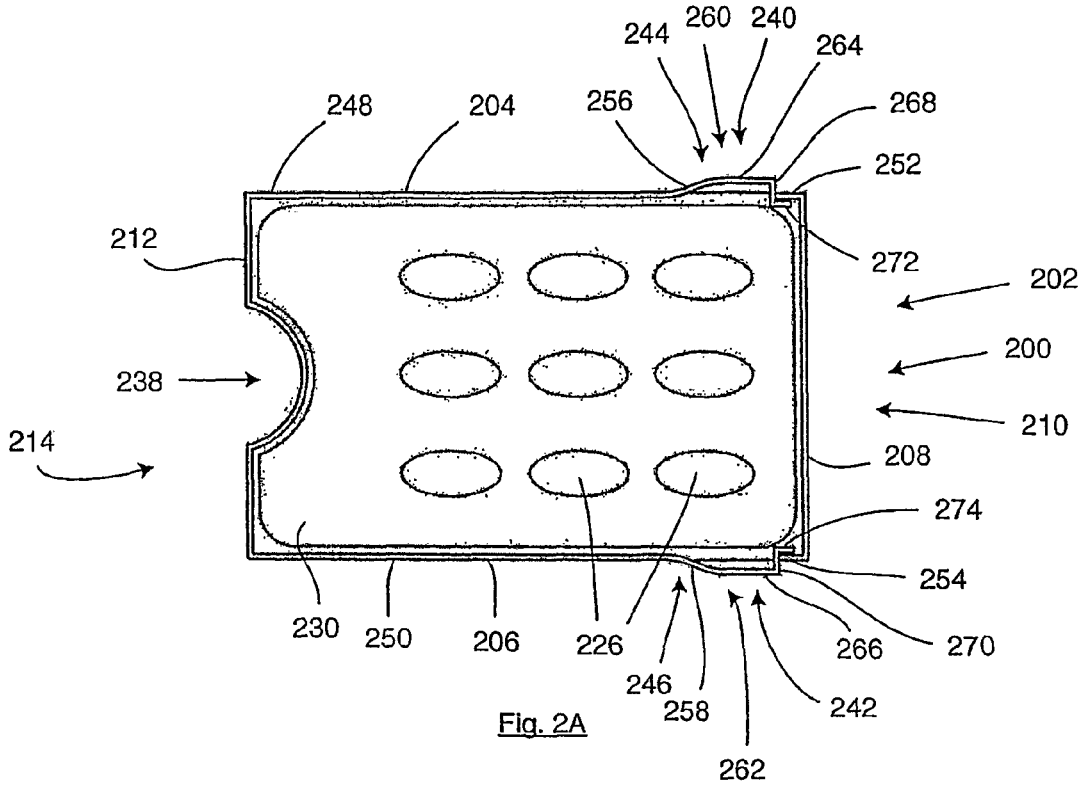
FIG. 2A is a base view of the storage tray of FIG. 1C.
Figure 2B:
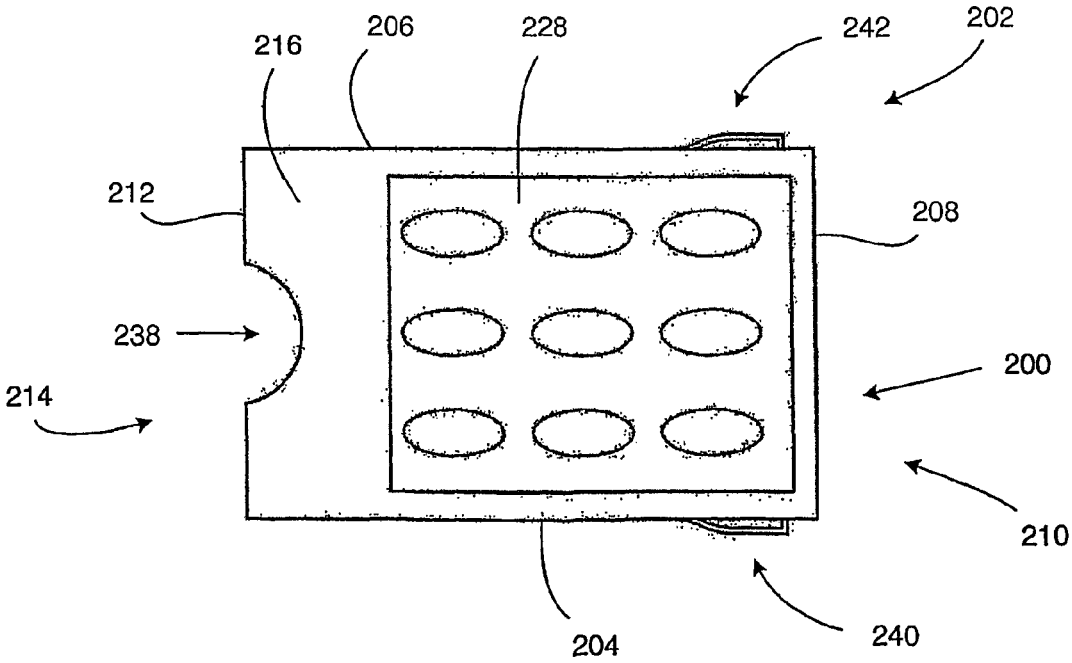
FIG. 2B is a plan view of the storage tray of FIG. 10.
Figure 2C:
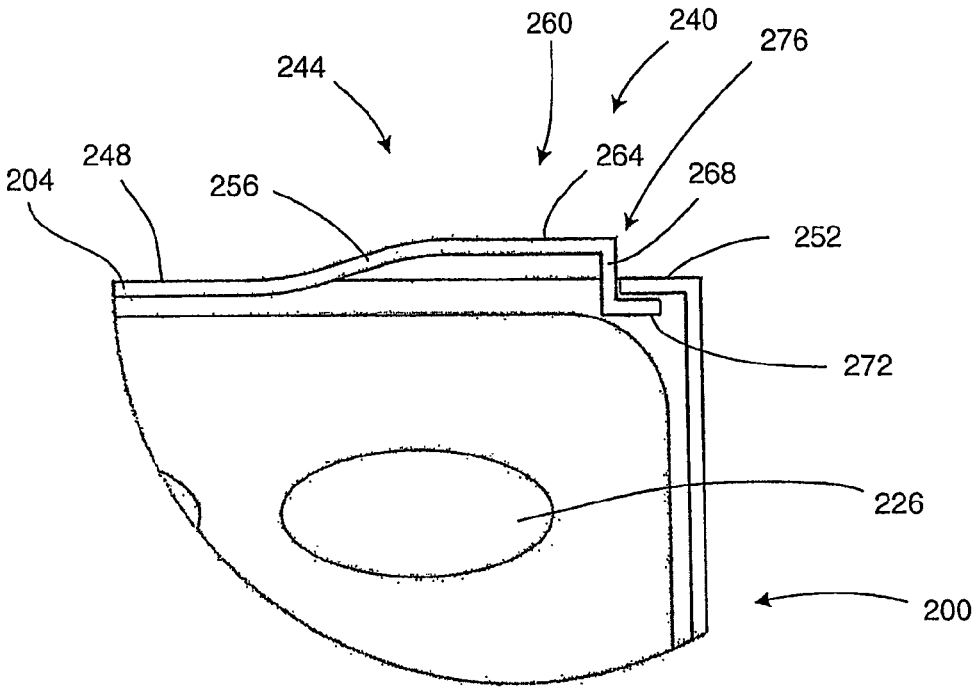
FIG. 2C is a partial enlarged detail view of the storage tray shown in FIG. 2A with a latch member in an engaged state.

By default, the natural flexibility and resilience of the live hinge 256 biases the left latch member 240 into its engaged state, which is illustrated in FIG. 2C. In the engaged state the button 260 of the left latch member 240 protrudes laterally beyond the remaining rear and front sections 248, 252 of the left wall 204 with the panel 264 of the button 260 lying substantially parallel to the left wall 204 and the shoulder 268 of the button 260 projecting orthogonally inwards. The button 260 thus forms a step or protrusion 276, which may engage a complementary formation of the sleeve 300 to prevent movement of the storage tray 200, as will be described later. The catch 272 projects orthogonally forward from the shoulder 268 to delimit lateral outward movement of the left latch member 240 by engaging the remaining front section 252 of the left wall 204 of the frame.

Figure 2D:
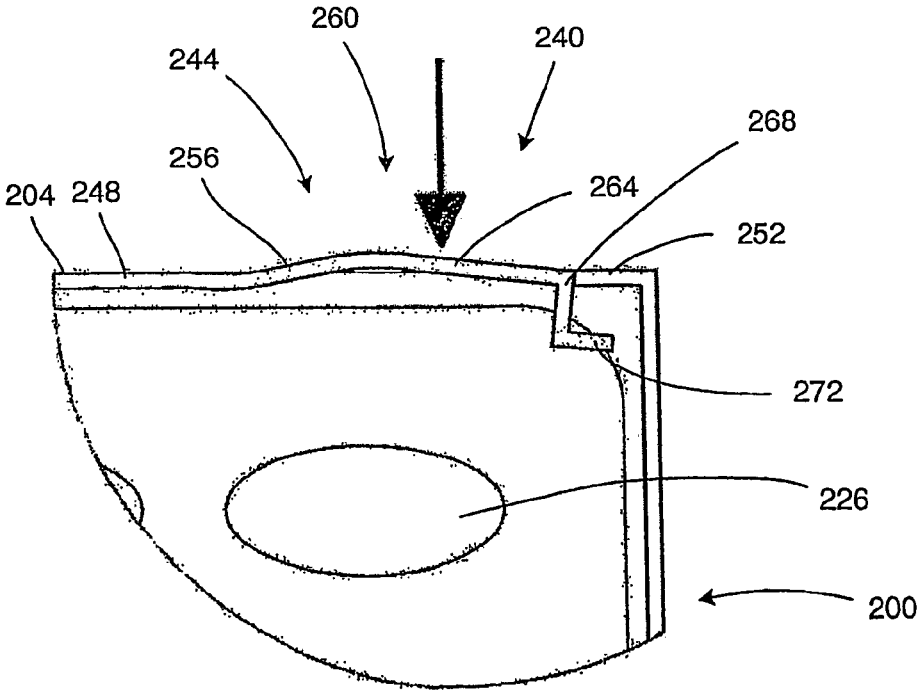
FIG. 2D is a partial enlarged detail view corresponding to FIG. 2C but with the latch member in a disengaged state.

When the panel 264 of the button 260 of the left latch member 240 is pressed inwardly by a user, i.e. towards the inside of the storage tray 200, against the bias of the live hinge 256, the left latch member 240 assumes its disengaged state, which is illustrated in FIG. 2D. In the disengaged state the live hinge 256 and the panel 264 of the button 260 lie substantially flush with the remaining rear and front sections 248, 252 of the left lateral wall 204, whilst the shoulder 268 and the catch 272 of the left latch member 240 are accommodated within the storage tray 200. In the disengaged state the button 260 of the left latch member 240 thus no longer forms a step or protrusion that can act to prevent movement of the storage tray 200.

In summary, the left and right latch members 240, 242 may each be moved independently between an engaged state in which they protrude laterally, and a disengaged state in which they lie flush with the lateral walls 204, 206 of the frame 202 of the storage tray 200.

Figure 3A:
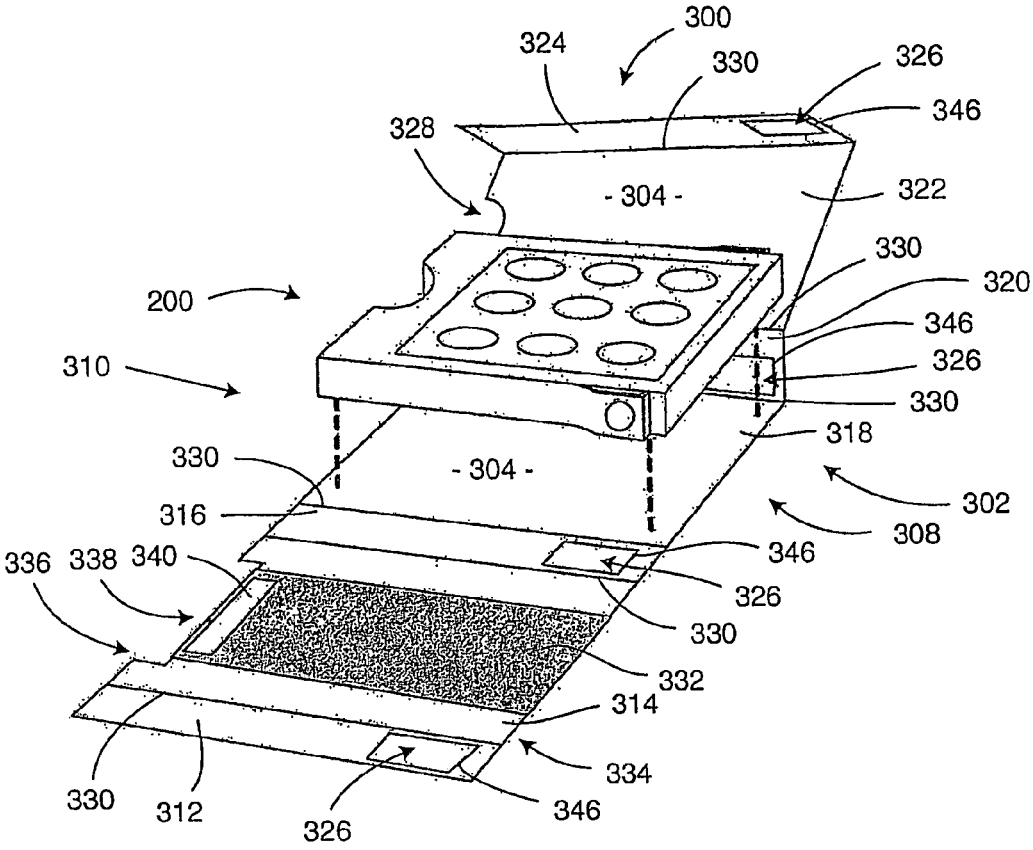
FIG. 3A is an exploded perspective view of the storage tray of FIG. 1B and a sleeve of the package according to the first embodiment of the invention, prior to assembly of the package.
Figure 3B:
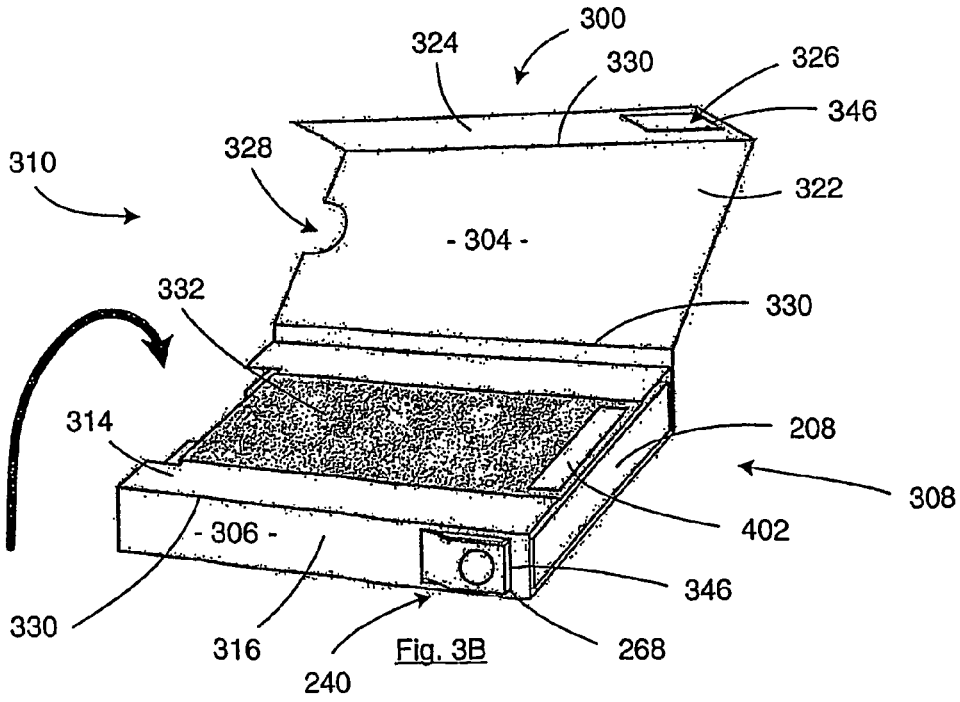
FIG. 3B is a perspective view of the storage tray and sleeve of FIG. 3A, after partial assembly of the package.

With reference to FIGS. 3A and 3B, in the assembled package 100, the storage tray 200 is housed within the sleeve 300.

The sleeve 300 comprises a flat blank 302, which has a first surface 304 on one side and a second surface 306 on the other side and is manufactured by cutting and creasing a sheet of flexible cardboard, plastics or other material. The blank 302 comprises a front end 308 and a rear end 310 and consists of seven integral, generally oblong sections 312, 314, 316, 318, 320, 322, 324, each extending from the front end 308 to the rear end 310. Three of the sections, namely a divider 314, a lower wall 318, and an upper wall 322 are relatively wide, and four, namely a right inner wall 312, a left inner wall 316, a right outer wall 320, and a left outer wall 324, are relatively narrow. All of the sections 312, 314, 316, 318, 320, 322, 324 are of substantially the same length: that length is greater than the width of the sections in the drawings, but it need not be greater. The narrow sections 312, 316, 320, 322 each comprise a generally oblong hole 326 near the front end of the blank 302, whilst the upper wall 322 comprises a curved indentation 328 at the rear end of the blank 302.

The sections 312, 314, 316, 318, 320, 322, 324 of the blank are integral and demarcated from each other by folds 330. The folds 330 are all made such that the first surface 304 of the flat blank 302 lies inward and the sleeve 300 is formed into a fully folded configuration by folding the flat blank 302 along the folds 330 successively in a coil-like manner. The holes 326 of the narrow sections 312, 316, 320, 322 are aligned with each other so as to form left and right holes 326 in left and right walls 312, 316, 320, 322 of the folded sleeve 300.

The divider 314 of the sleeve 300 supports an endless belt 332, to which the storage tray 200 and the tab member 400 are attached as will be described. The belt 332 is typically a strip of a low-friction sheet material such as plastics film, e.g. polypropylene sold under the trade mark Treofan GND, and runs parallel to, and within, the folds 330 bordering the divider 314, on both surfaces 304, 306 of the flat blank 302, sliding around forward-facing and rearward-facing edges 334, 336 of the divider 314. Thus, the belt 332 passes around the divider 314 along a longitudinal belt path. To aid alignment of the belt 332 in the belt path, the divider 314 comprises a waist or cutout 338 at the rearward-facing edge 336.

Before the flat blank 302 is folded along its folds 330 to bring the sleeve 300 into the fully folded configuration, the storage tray 200 and the tab member 400 are attached to the belt 332, as illustrated in sequential FIGS. 3A, 3B, 4A and 4B as follows.

With reference to FIG. 3A, the storage tray 200 is initially placed on the first surface 304 of the lower wall 318 of the blank 302, with the flange 216 facing away from the blank 302 and the latch members 240, 242 aligned with, and receivable within, the holes 326 in the left and right walls 312, 316, 320, 324 of the blank 302.

Thereafter, as illustrated in FIG. 3B, the right inner wall 312, divider 314, and left inner wall 316 of the blank 302 are folded over the storage tray 200 so that the belt 332 of the divider 314 is aligned with the storage tray 200. The left latch member 240 is received by the hole 326 of the left inner wail 316, whilst the right latch member 242 is received by the holes 326 of the right inner wall 312 and the right outer wall 324, which is bonded to the right inner wall 312 of the blank. The belt 332 is bonded to the storage tray 200 at a first bonding point 340, which joins a rear section of the flange 216 of the frame 202 to the belt 332 where the belt 332 overlies the first surface 304 of the divider 314 near the rear end 310 of the blank 302.

Figure 4A:
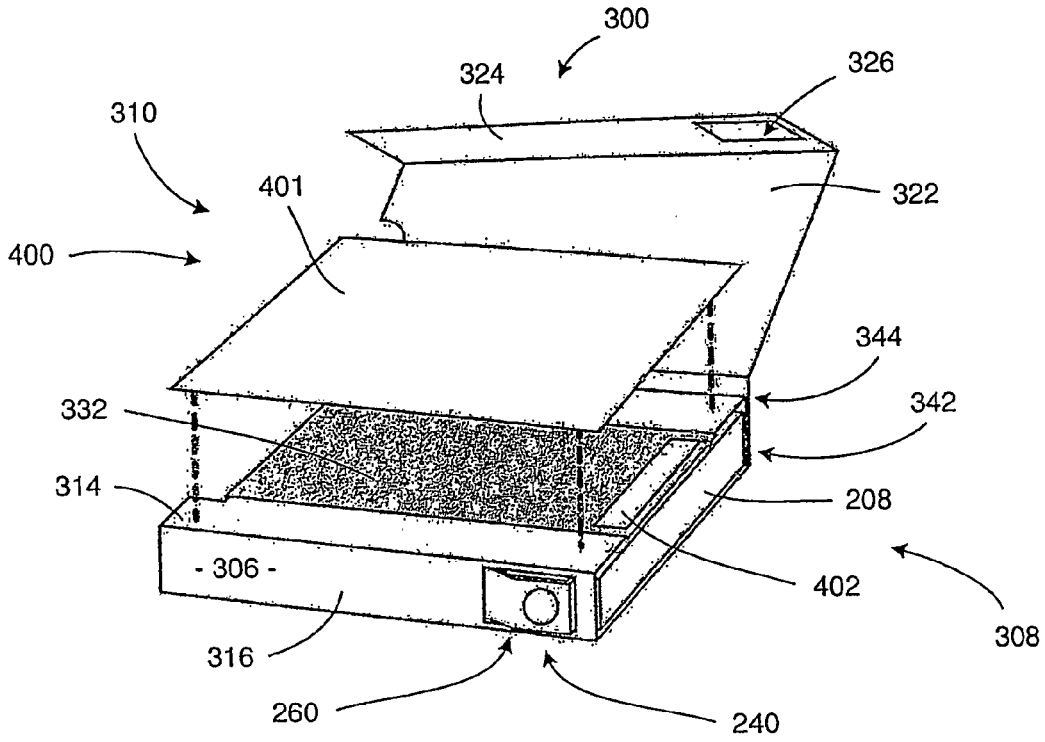
FIG. 4A is a perspective view of the storage tray and sleeve of FIG. 3A and a tab member of the package according to the first embodiment of the invention, after partial assembly of the package.

Referring to FIG. 4A, once the storage tray 200 has been secured to the belt 332, the tab member 400, which comprises an oblong cardboard panel having a grip 401 or a finger hole (not shown), is bonded to the belt 332 at a second bonding point 402, where the belt 332 overlies the second surface 306 of the divider 314 near the front end 308 of the blank 302.

Figure 4B:
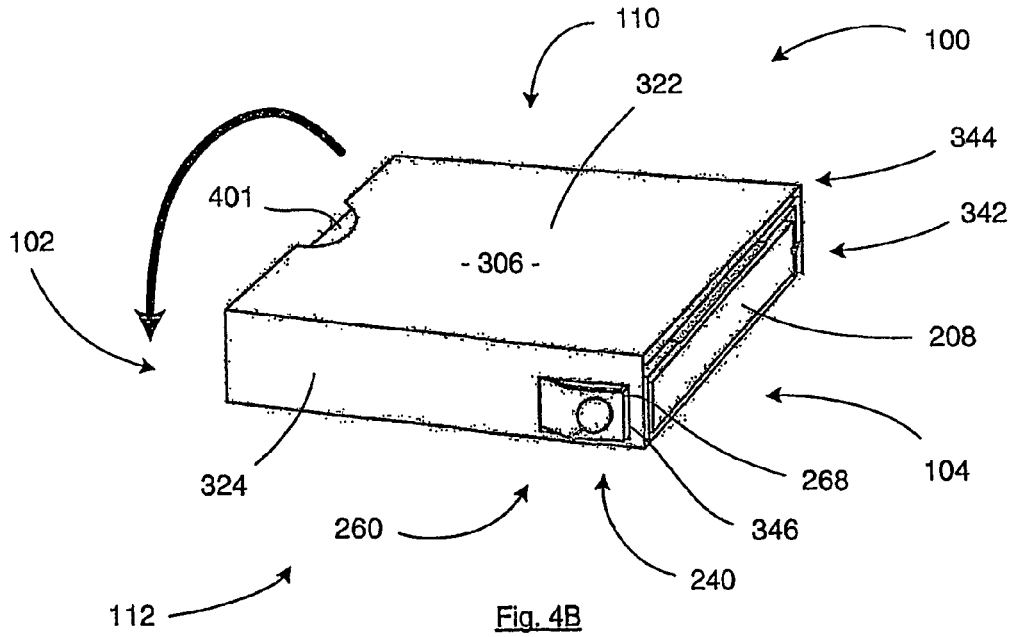
FIG. 4B is a perspective view of the package according to the first embodiment of the invention, after assembly, in a fully closed state.

Finally, as illustrated in FIG. 4B, the upper wall 322 and the outer left wall 324 of the sleeve 300 are folded over the tab member 400. The outer left wall 324 is bonded to the inner left wall 316, with the holes 326 aligned, to complete assembly of the package 100.

In the assembled package 100 the storage tray 200 is housed within a lower passage 342 of the sleeve 300 whilst the tab member 400 is housed in an upper passage 344 of the sleeve 300. The divider 314 of the sleeve 300 separates the upper passage 344 and the lower passage 342.

Figure 5A:
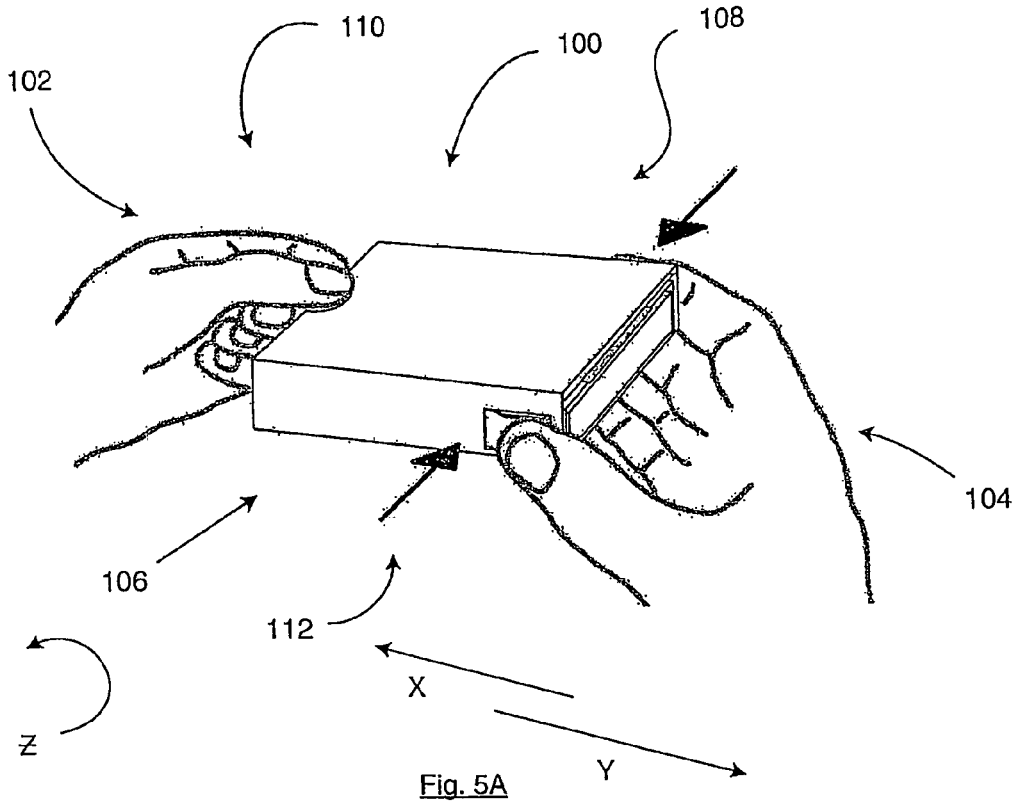
FIG. 5A is a perspective view of the package of FIG. 4B in the fully closed state, showing disengagement of left and right latch members by a user.
Figure 5B:
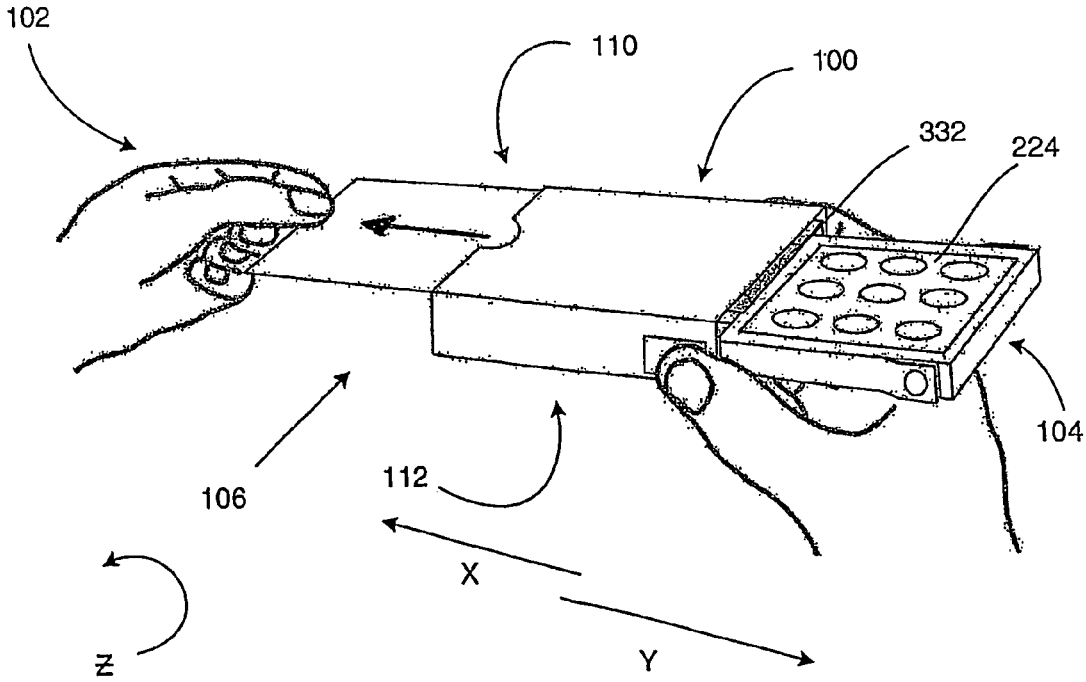
FIG. 5B is a perspective view of the package of FIG. 5A in a fully open state, following actuation by a user.

Referring to FIGS. 5A and 5B, the assembled package 100 can be brought from a fully closed state shown in FIG. 5A, in which the content of the blister-pack 224 is inaccessible, into a fully open state shown in FIG. 5B, in which the content of the blister-pack 224 is accessible. To provide the desired child resistance, the latch members 240, 242 act in synergy with the belt 332 and divider 314 of the package 100 to make it difficult for children to bring the package 100 from the closed state into the open state. Yet, adults find it easy to open the package 100 even if they are infirm or lack dexterity.

When the latch members 240, 242 are in the engaged state, their buttons 260, 262 engage the holes 326 of the side walls 312, 316, 320, 324 of the sleeve 300, with the shoulders 268, 270 facing towards the front end 104 of the package 100. Thus the shoulders 268, 270 abut against respective front edges 346 of the holes 326 to prevent movement of the storage tray 200 in the direction of arrow Y. Movement of the storage tray 200 in direction Y can only occur when the latch members 240, 242 are simultaneously brought into their disengaged state by a user pressing the buttons 260, 262 towards each other in a squeezing action between thumb and forefinger.

The belt 332 supported by the divider 314 links sliding movement of the storage tray 200 and the tab member 400 as described in our European patent number EP1140639.

Provided that the left and right latch members 240, 242 have been moved into their disengaged states as described above, the tab member 400 can be pulled in the direction of arrow X, aided by the indentations 328 in the upper wall 322 of the sleeve and the storage tray 200. The tab member 400 may thereby be moved from the fully closed state in direction X, causing the belt 332 to turn about the divider 314 in the direction of arrow Z, since the tab member 400 is secured to the belt 332 at the second bonding point 402.

The movement of the belt 332 causes the storage 300 tray to move in the direction of arrow Y, since the storage tray 200 is also attached to the belt 332 at the first bonding point 340 on the other side 304 of the divider 314. When the first and second bonding points 340, 402 reach the edges of the divider at the front and rear ends 104, 102 of the package 100, the tab member 400 can be pulled no further in the direction of arrow X and the storage tray 200 can move no further in direction Y. The package 100 is then in the fully open state shown in FIG. 5B.

The tab member 400 works synergistically with the latch members 240, 242 to provide child resistance. Users of the package 100 cannot easily apply force in direction Y through the latch members 240, 242. Instead, to gain access to the blister-pack 224, it is necessary to hold the left and right latch members 240, 242 in the disengaged state with one hand, and, simultaneously, to apply an opening force on the tab member 400 at the opposite end of the package with the other hand. The force that is required to access the storage tray 200, by moving it in direction Y, is reversed by the belt 332, such that an opposite opening force, in direction X, must be applied to the tab member 400 at an opposite end 102 of the package 100 whilst the latch members 240, 242 are simultaneously disengaged.

When the tab member 400 is moved back in the direction of arrow Y, the tab member 400 causes the belt 332 to turn about the divider 314 in a direction opposite to arrow Z, so that the storage tray 200 moves in the direction of arrow X. When the bonding points 340, 402 reach the opposite edges of the divider 314, further movement of the storage tray 200 in direction X is prevented and the package 100 is back in the fully closed state.

If preferred, a user can push the storage tray 200 in the direction of arrow X to close the storage tray 200, which in turn pulls the tab member 400 back into the sleeve 300. The effect is the same, in that both the storage tray 200 and the tab member 400 will return to the fully closed state in which the storage tray 200 is inaccessibly housed within the sleeve 300.

When the storage tray 200 is returned into the sleeve 300 from the fully open state, the side walls 312, 316, 320, 324 of the sleeve 300 initially push the left and right latch members 240, 242 into the disengaged state. The ramp-like taper of the latch members 240,242 between their buttons 260, 262 and live hinges 256, 258 enables this inward movement. However, when the buttons 260, 262 of the latch members 240, 242 reach their associated holes 236 in the side walls 312, 316, 320, 324, they are biased into the engaged state. Thus the left and right latch members 240, 242 engage in a snap fit with the sleeve 300 when the storage tray 200 is returned into the sleeve 300 in direction X.

As is evident from the above description, in addition to linking the storage tray 200 and the tab member 400, the belt 332 surrounding the divider 312 delimits sliding movement of the storage tray 200 and the tab member 400. The first and second bonding points 340, 402 reach opposite edges of the divider 314 at the front and rear ends of the package 104, 102 in the fully open and fully closed states. As a result, the storage tray 200 is prevented from moving in direction Y in the fully open state. Similarly, the belt prevents the storage tray 200 from moving in direction X in the fully closed state.

Since, in the fully closed state, the latch members 240, 242 of the storage tray 200 additionally prevent movement of the storage tray 200 in direction Y, any hazardous materials held by the storage tray 200 remain inaccessible to children. The divider 314 and belt 332 act in synergy with the latch members 240, 242 to provide child resistance.

Referring to FIGS. 6 to 9, in a second embodiment of the invention a child resistant package 500 comprises: a storage tray 600 for storing hazardous materials, a structure, in the form of a sleeve 300 for blocking access to the hazardous materials, a tab member 400 for actuating the storage tray; and a safety clip 700. The package 500 comprises a rear end 502, a front end 504, and a left side 506, a right side 508, an upper side 510 and a lower side 512.

Figure 6A:
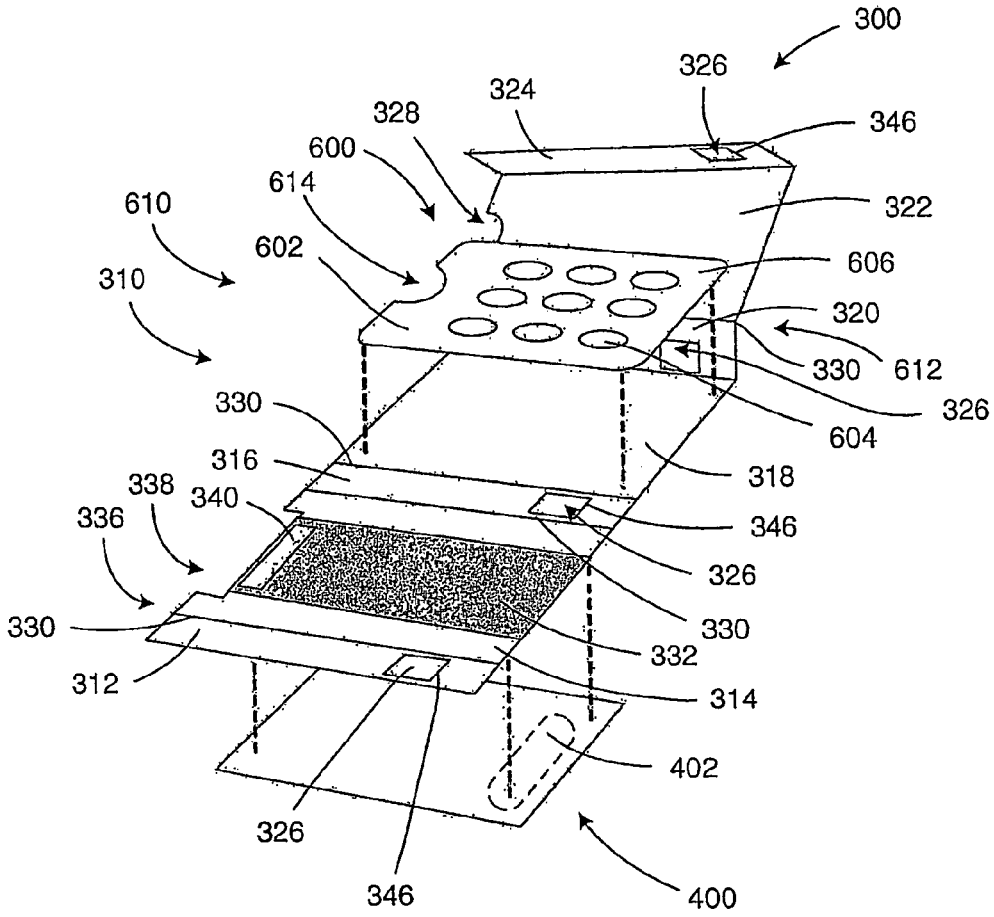
FIG. 6A is an exploded perspective view of a storage tray, sleeve and tab member of a package according to a second embodiment of the invention, prior to assembly of the package.
Figure 6B:
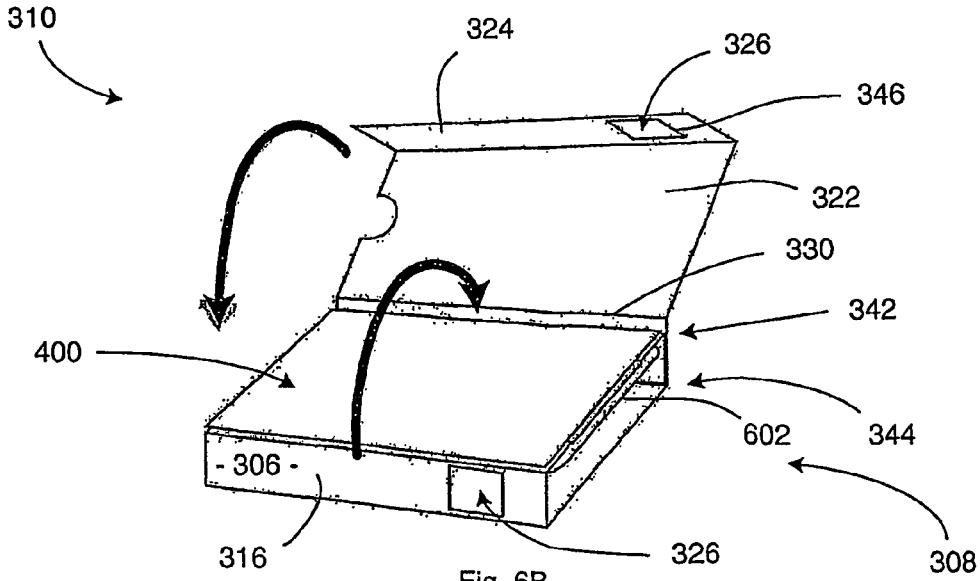
FIG. 6B is a perspective view of the storage tray, sleeve and tab member of FIG. 6A, after partial assembly of the package

Referring to FIG. 6A, the storage tray 600 of the package of the second embodiment of the invention comprises a generally oblong blister-pack 602. The blister-pack 602 provides storage for hazardous materials within a plurality of blisters 604 in conventional fashion and comprises an upper, foil-covered side 606, a lower blistered side (not visible in the drawings), a rear end 610 and a front end 612. A curved indentation 614 is provided at the rear end 610 of the blister-pack 602.

The sleeve 300 and tab member 400 of the package 500 of the second embodiment of the invention are also shown in FIG. 6A and are identical in structure to the sleeve 300 and tab member 400 of the package 100 of the first embodiment of the invention. Similarly, with reference to FIGS. 6A and 6B, the assembly of the sleeve 300, storage tray 600 and tab member 400 of the package 500 of the second embodiment is identical to that described in respect of the package 100 of the first embodiment, save that in the package 500 of the second embodiment the blister-pack 602 of the storage tray 600 is directly attached to the belt 332 at the second bonding point 402. Due to these similarities, to describe the structure of the sleeve 300 and tab member 400 of the package 500 of the second embodiment, and the assembly of the sleeve 300, storage tray 600 and tab member 400, reference is simply made to the relevant description provided in respect of the package 100 of the first embodiment. Like reference numerals have been used throughout for like parts. It will be noted that, as the storage tray 600 of the package 500 of the second embodiment does not comprise latch members, the holes 326 in the side walls 312, 316, 320, 324 of the sleeve 300 remain unengaged in the absence of the safety clip 700, which will now be described in detail.

Referring to FIGS. 7A to 7C, the safety clip 700 of the package 500 of the second embodiment comprises a plastics bracket 702 which is U shaped in plan. The bracket 702 comprises an elongate central panel 704 having an integral grip 706 on an outer surface 708 facing an outer side 710 of the panel 704. At left and right ends 712, 714 of the central panel 704, parallel left and right latch members 716, 718 of the bracket 702 respectively extend orthogonally from an opposite, inner side 720 of the panel 704. The left and right latch members 716, 718 respectively comprise a spring arm 722, 724 having a live hinge 726, 728 adjoining a respective end 712, 714 of the central panel 704 and a laterally raised button 734, 736 separated from the live hinge 726, 728 by a shoulder 738, 740.

The left and right latch members 716, 718 of the safety clip 700 are resiliently biased outwardly into an engaged state shown in FIGS. 7A to 7C in which they lie substantially orthogonally to the central panel 704, with the buttons 734, 736 protruding laterally beyond the live hinges 726, 728. However, when inward lateral pressure is applied as shown in FIG. 7D, the live hinges 726, 728 flex resiliently and the left and right latch members 716, 718 assume a disengaged state in which the maximum lateral width of the safety clip 700 is defined by the lateral width of the central panel 704. In other words, the left and right latch members 716, 718 can be resiliently bent inwards so that they no longer protrude laterally beyond the central panel 704.

The safety clip 700 is complementary with the folded sleeve 300 of the package 500 of the second embodiment of the invention. Specifically, with reference to FIGS. 8A and 8B, to complete assembly of the package 500 after the sleeve 300, storage tray 600 and tab member 400 have been combined, the safety clip 700 engages in a snap fit with the front end 308 of the sleeve 300 such that the left and right latch members 716, 718 engage the left and right holes 326 of the sleeve 300 respectively and the central panel 704 covers the lower passage 342 defined by the sleeve. When the safety clip 700 is engaged in this manner, the package 500 of the second embodiment is in a fully closed position shown in FIG. 8B.

Figure 8A:
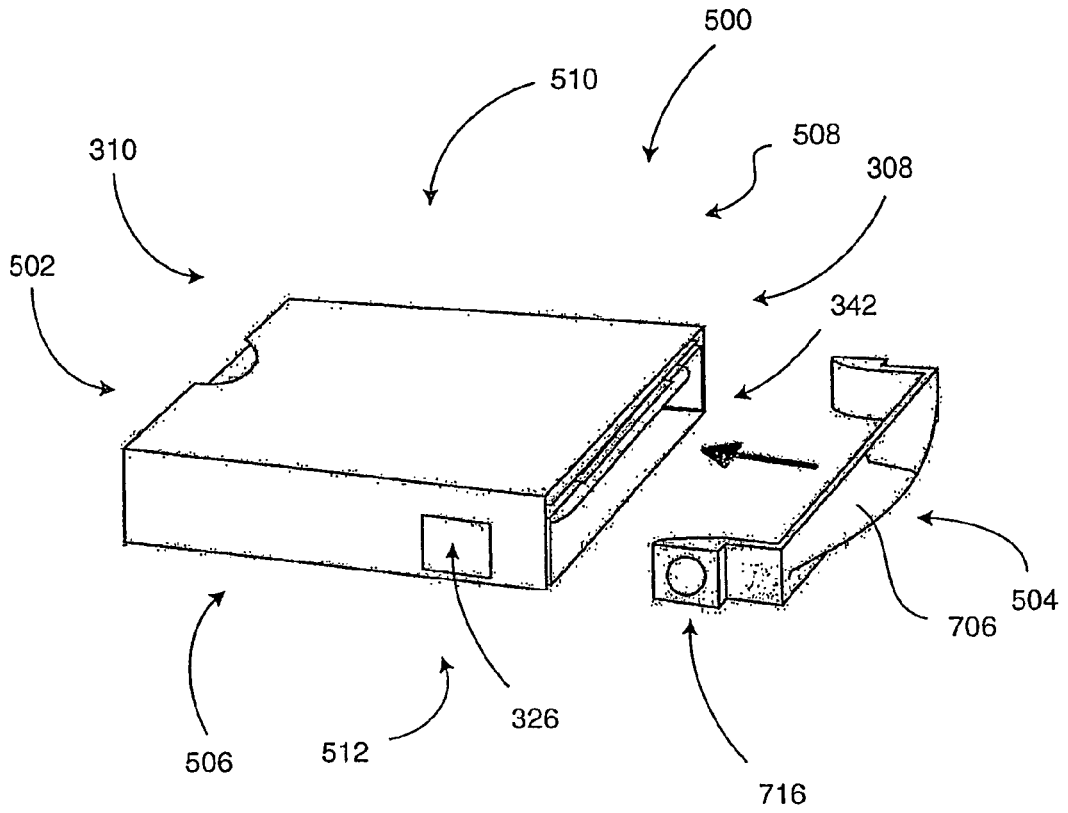
FIG. 8A is a perspective view of the package according to the second embodiment of the invention with the safety clip disengaged.
Figure 8B:
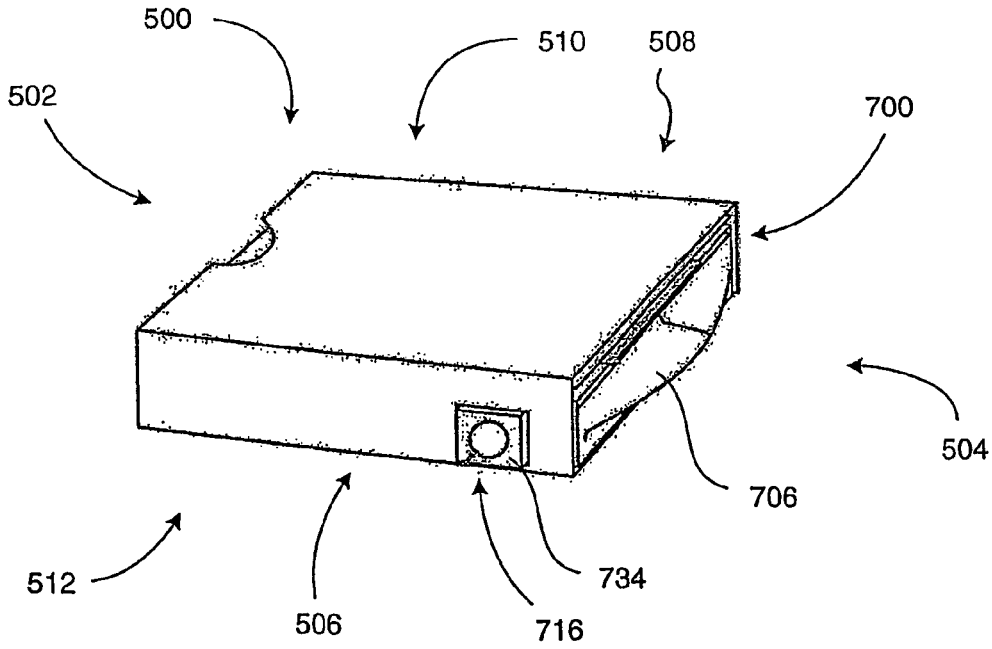
FIG. 8B is a perspective view of the package of FIG. 8A with the safety clip engaged and in a fully closed position.
Figure 9A:
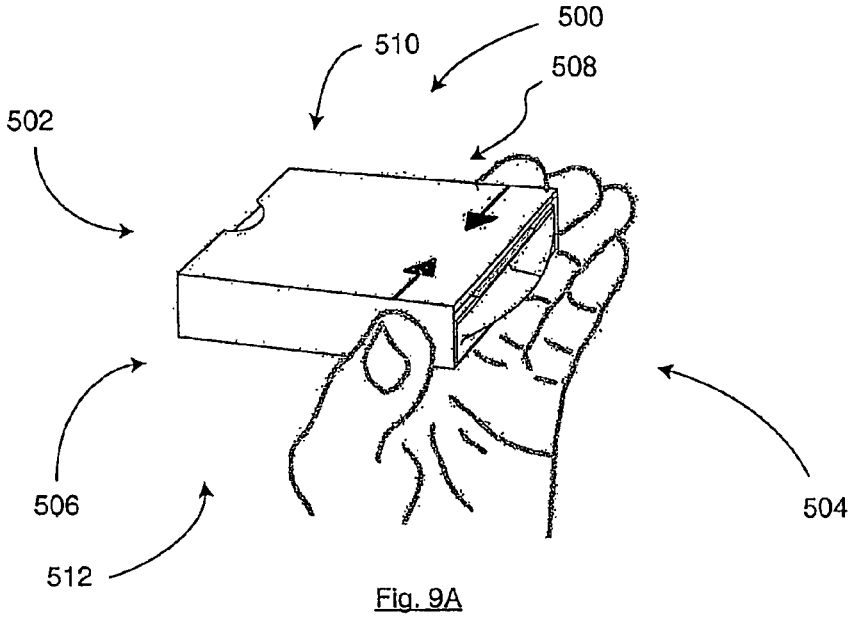
FIG. 9A is a perspective view of the package of FIGS. 8A and 8B showing disengagement of left and right latch members of the safety clip by a user.
Figure 9B:
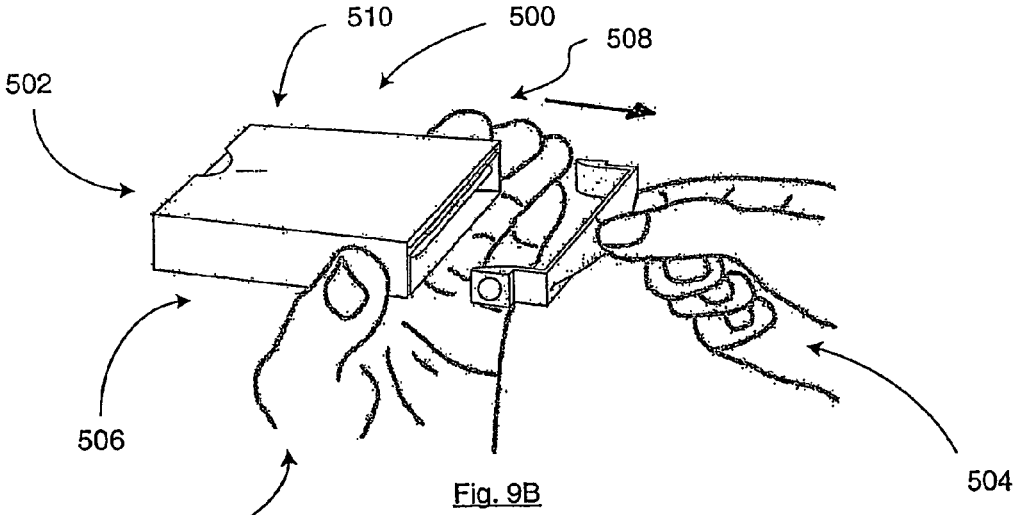
FIG. 9B is a perspective view of the package of FIGS. 8A, 8B and 9A showing removal of the safety clip by a user.
Figure 9C:
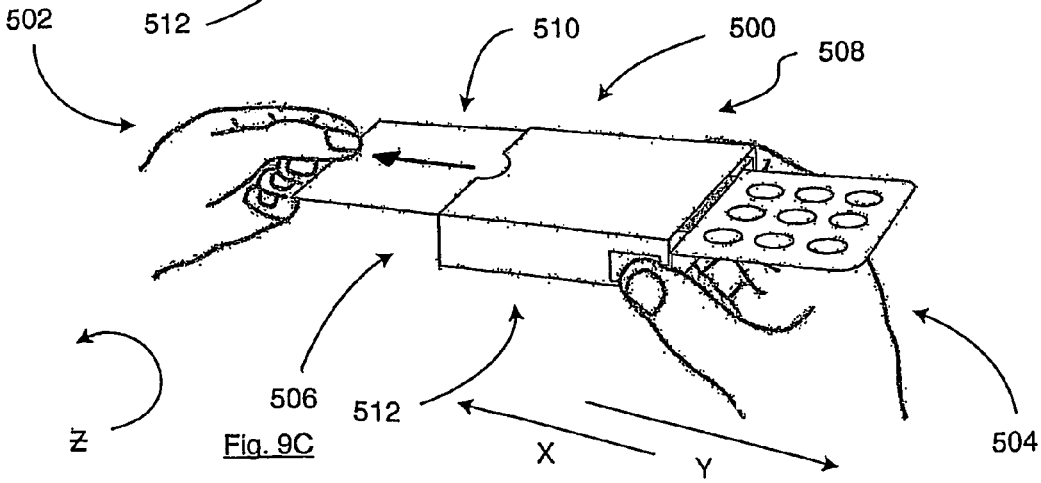
FIG. 9C is a perspective view of the package of FIGS. 8A, 8B, 9A and 9B in a fully open state, following removal of the safety clip and actuation by a user.

Referring now to sequential FIGS. 9A to 9C, to gain access to the content of the storage tray 600, the package 500 can be brought from the fully closed position of FIGS. 8B and 9A into a fully open position shown in FIG. 9C by: applying lateral pressure to the buttons 734, 736 of the safety clip 700 to disengage the latch members 716, 718 from the holes 326; removing the safety clip 700; and pulling the tab member 400 in direction X.

The tab member 400 and the storage tray 600 of the package 500 of the second embodiment are linked by the belt 332 surrounding the divider 314, exactly like the tab member 400 and the storage tray 200 of the package 100 of the first embodiment of the invention. In respect of the movement of the storage tray 600 and tab member 400 once the safety clip 700 has been removed, reference is therefore once again made to the corresponding description provided above in respect of the package 100 of the first embodiment.

In addition to linking the storage tray 600 and the tab member 400, the belt 332 surrounding the divider 314 delimits sliding movement of the storage tray 600 and the tab member 400. The first and second bonding points 340, 402 reach opposite edges of the divider 314 at the front and rear of the package 504, 502 in the fully open and fully closed states. As a result, the storage tray 600 is prevented from moving in direction Y in the fully open state. Similarly, the belt 332 prevents the storage tray 600 from moving in direction X in the fully closed state.

In the fully closed state, the safety clip 700 additionally prevents movement of the storage tray 600 in direction Y because the central panel 704 blocks the front end 504 of the lower passage 342 of the sleeve 300. Therefore, any hazardous materials held by the storage tray 600 remain inaccessible to children until the safety clip 700 is removed and the tab member 400 is pulled in direction X. The divider 314 and belt 332 thus act in synergy with the safety clip 700 to provide child resistance.

Referring to FIGS. 10A to 13B, in a third embodiment of the invention a child resistant package 800 comprises a support in the form of a storage tray 850 for storing hazardous materials (not shown), a structure, in the form of a sleeve 900 for blocking access to the hazardous materials, and a tab member 950 for actuating the storage tray 850. The package 800 comprises a rear end 802, a front end 804, a left side 806, a right side 808, an upper side 810, and a lower side 812.

Figure 10A:
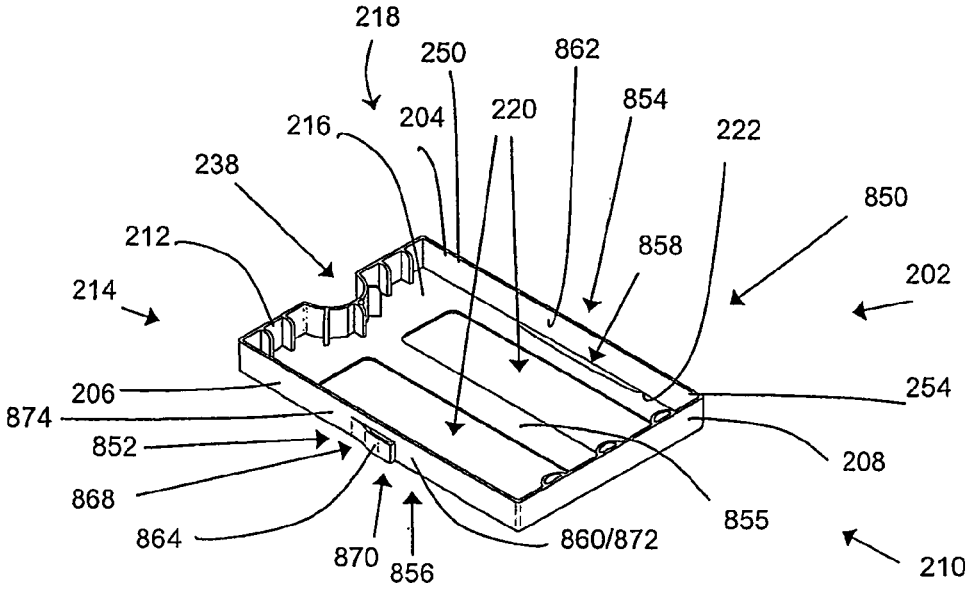
FIG. 10A is a perspective view of a frame of a storage tray of a package according to a third embodiment of the invention.
Figure 10B:
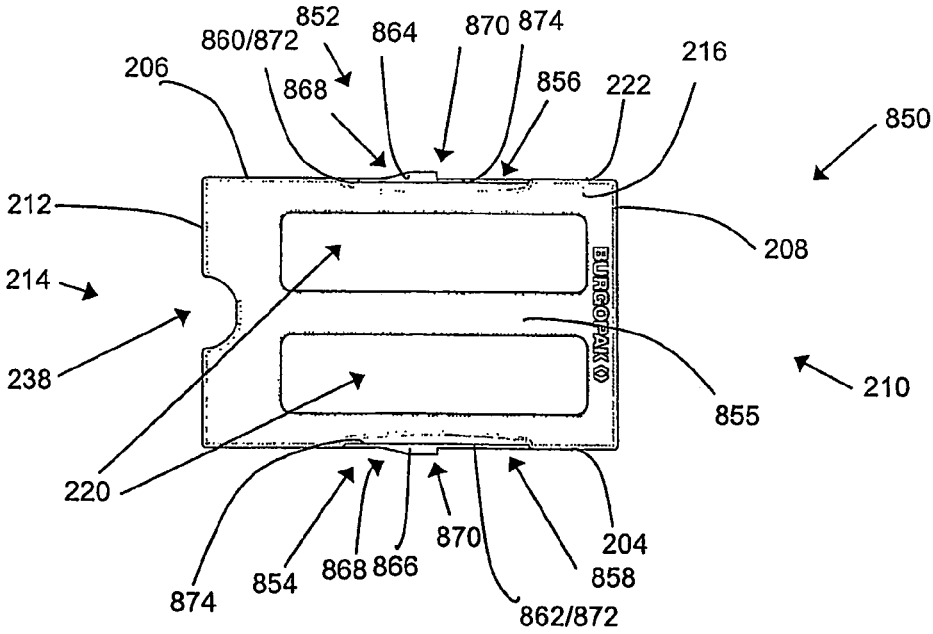
FIG. 10B is a plan view of the frame of FIG. 10A.

With reference to FIGS. 10A and 10B, the structure of the storage tray 850 of the package 800 according to the third embodiment of the invention is essentially identical to that of the storage tray 200 of the package 100 according to the first embodiment of the invention, save for the location and structure of right and left latch members 852, 854, and the addition of a brace or strut 855. Although not shown in FIGS. 10A to 13B, the storage tray 850 also comprises a blister pack.

To explain the identical features of the of the storage tray 850 of the package 800 according to the third embodiment of the invention without duplication, reference is simply made to relevant parts of the above description in respect of the first embodiment. Like reference numerals are used for like parts in FIGS. 10A to 13B.

The differing structure of the latch members 852, 854 of the storage tray 850 of the package 800 according to the third embodiment of the invention will now be described in detail.

The frame 202 of the storage tray 850 is symmetrical about a central longitudinal axis (not shown). Therefore, the left and right latch members 852, 854 are mirror images of each other and function identically. Each latch member 852, 854 is defined by a respective cut-out 856, 858 in the flange 216 of the frame 202. Specifically, the cut-outs 856, 858 define, and provide clearance for inward movement of, left and right movable sections 860, 862 of the flexible left and right walls 204, 206 of the frame 202 respectively. The sections 860, 862 comprise a respective integral engagement formation 864, 866 and form the latch members 852, 854. The engagement formations 864, 866 each comprise a ramp 868 and a forward facing shoulder 870 and are located substantially centrally between the front and rear ends 210, 214 of the storage tray 850.

As apparent from the above description, in contrast to the latch members 240, 242 of the package 100 according to the first embodiment of the invention, the latch members 852, 854 of the package 800 according to the third embodiment of the invention each comprise not one but two live hinges 872, 874 contiguous with associated lateral walls 204, 206. Further, the latch members 852, 854 are located at a different position, namely substantially centrally between the front and rear ends 210, 214 of the storage tray 850.

The latch members 852, 854 are each resiliently movable between an engaged state and a disengaged state. Details of the engaged and disengaged states of the right latch member 854 will now be described with reference to FIGS. 11A to 11C. The skilled reader will appreciate that since the left and right latch members 852, 854 function identically, the description of the engaged and disengaged states of the right latch member 854 is also relevant to the left latch member 852.

Figure 11A:
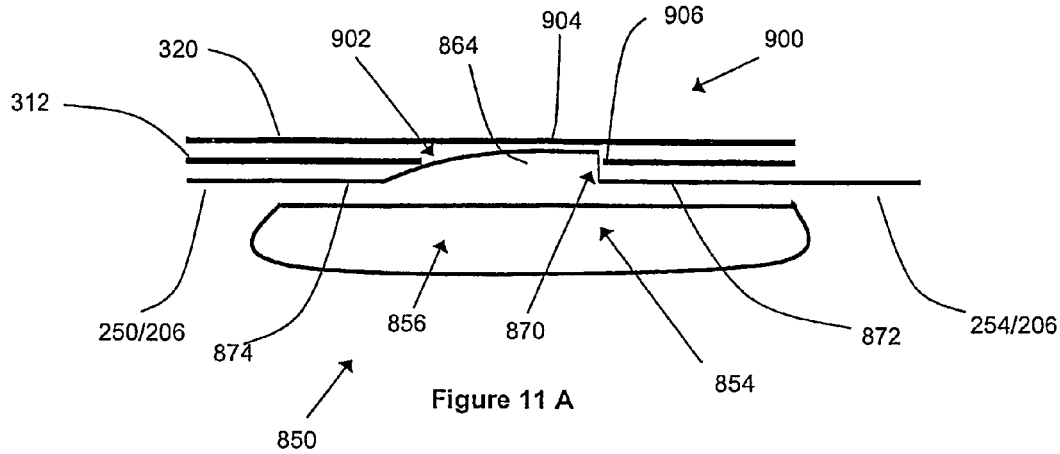
FIGS. 11A, 11B and 11C are sequential, schematic, partial views of the frame shown in FIG. 10A, showing movement of a latch member between an engaged state and a disengaged state, and interaction of the latch member with a sleeve of the package according to the third embodiment of the invention.

By default, the natural flexibility and resilience of the live hinges 872, 874 biases the right latch member 854 outwardly into its engaged state, which is illustrated in FIG. 11A. In the engaged state the engagement formation 864 of the right latch member 854 protrudes laterally beyond the remaining rear and front sections 250, 254 of the right wall 206 of the storage tray 850 with the orthogonal shoulder 870 facing forwards. The engagement formation 864 thus forms a step or protrusion, which may engage a complementary formation of the sleeve 900 to prevent movement of the storage tray 850, as will be described later.

Figure 11B:
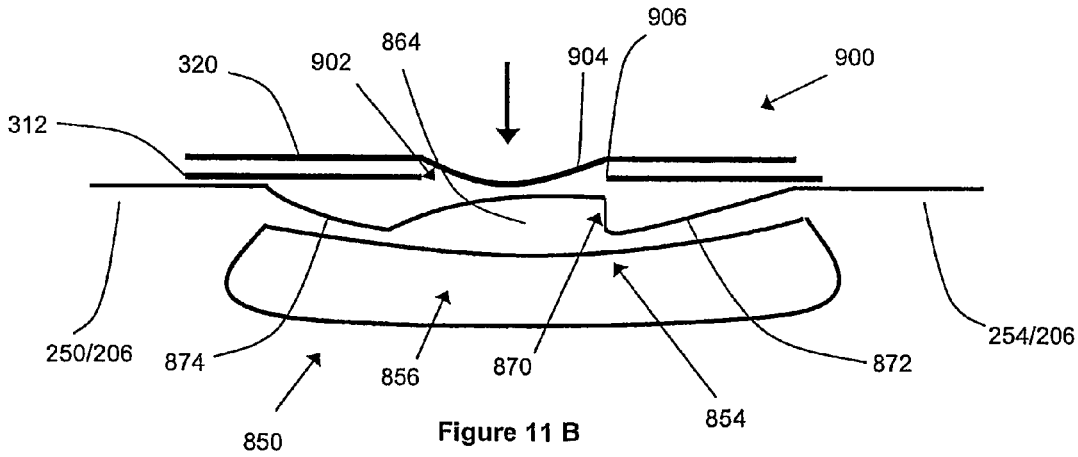
Figure 11C:
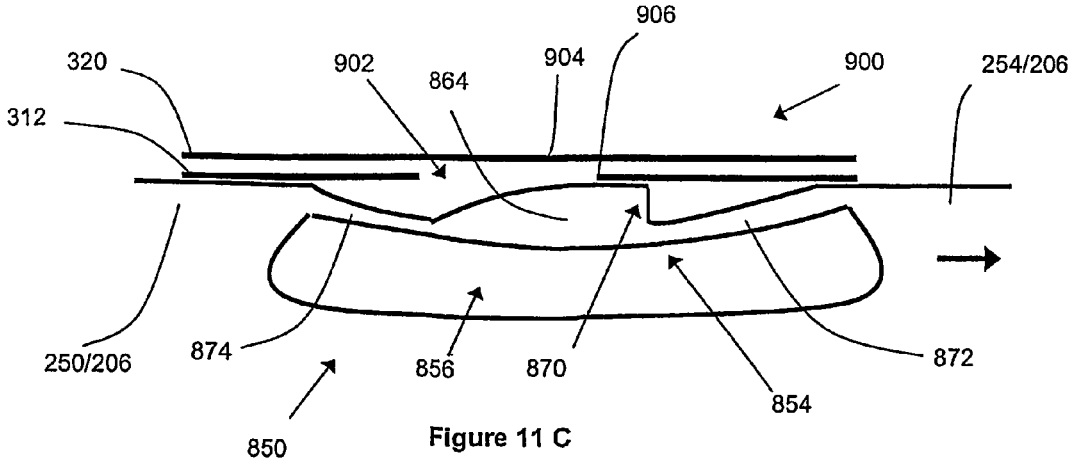

When the engagement formation 864 of the right latch member 854 is pressed inwardly by a user, i.e. towards the inside of the storage tray 850, against the bias of the live hinges 872, 874, the right latch member 854 assumes its disengaged state, which is illustrated in FIGS. 11B and 11C. In the disengaged state the engagement formation 864 lies substantially flush with the remaining rear and front sections 250, 254 of the right lateral wall 206, whilst the shoulder 870 is accommodated within the generally oblong storage tray 850. In the disengaged state the engagement formation 864 thus no longer forms a step or protrusion that can act to prevent movement of the storage tray 850, and the storage tray can be moved with respect to the sleeve as illustrated in FIG. 11C.

In summary, the left and right latch members 852, 854 may each be moved independently between an engaged state in which they protrude laterally, and a disengaged state in which they lie substantially flush with the lateral walls 204, 206 of the frame 202 of the storage tray 850.

Figure 10C:
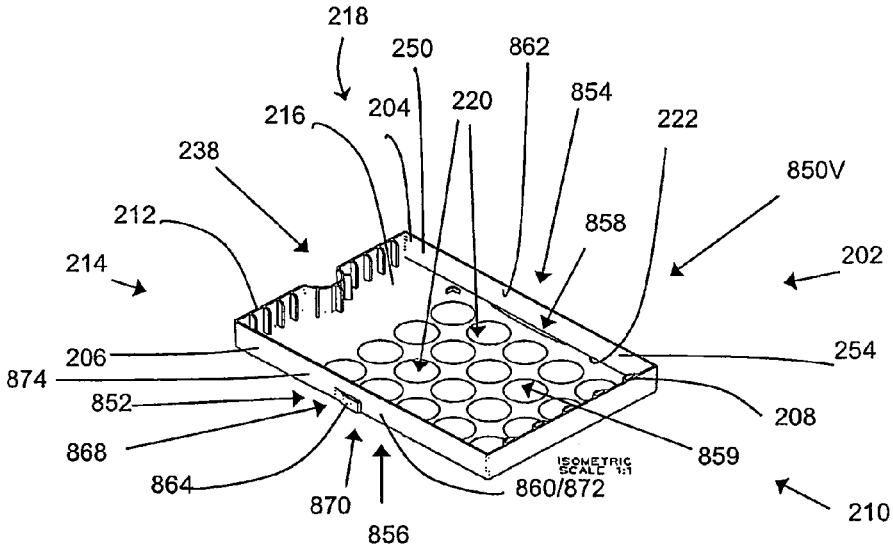
FIG. 10C is a perspective view of a frame of a variant storage tray, which may be used interchangeably with the storage tray of FIG. 10A in the package according to the third embodiment of the invention.

Referring again to FIGS. 10A and 10B, to provide additional support for the blister pack (not shown), the frame 202 of the storage tray 850 comprises a strut 855 which complements the flange 216 and runs centrally from the rear end 214 to the front end 210 of the storage tray 850. The strut 855 is not essential and could be omitted or replaced by other forms of support. By way of illustration, FIG. 10C shows a variant 850V of the storage tray 850 in which the frame 202 has been modified to comprise a support web 857 comprising circular holes 859 instead of a strut. The circular holes 859 allow access to the content of a supported blister pack (not shown), while reducing material usage, with the web 857 providing improved support. The variant 850V of the storage tray 850 may be used interchangeably with the storage tray 850 of FIGS. 10A and 10B in the package 800 according to the third embodiment of the invention.

Figure 12:
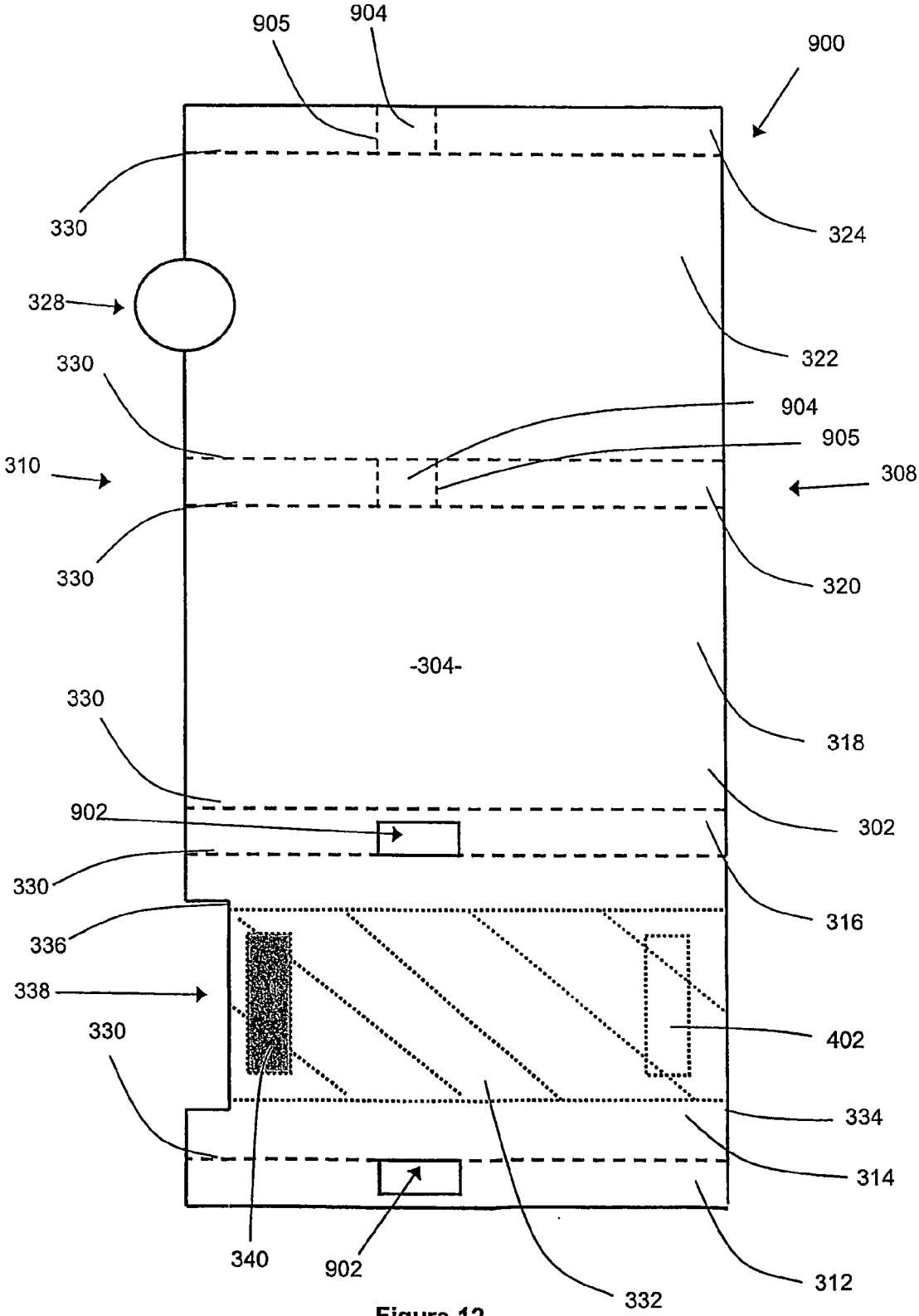
FIG. 12 is a plan view of a blank for forming the sleeve shown in FIGS. 11A, 11B and 11C.

With reference to FIG. 12, the sleeve 900 of the package 800 according to the third embodiment of the invention is essentially identical to the sleeve 300 of the package 100 according to the first embodiment of the invention, save that only the right and left inner walls 312, 316 of the sleeve comprise holes 902 (whilst the right and left outer walls act as covers), and that the position of the holes 902 is different.

To explain the identical features of the of the sleeve 900 of the package 800 according to the third embodiment of the invention without duplication, reference is simply made to relevant parts of the above description in respect of the first embodiment. Like reference numerals are used for like parts in FIGS. 11A to 13B.

The differing structure of the left and right inner and outer walls 312, 316, 320, 324 of the sleeve 900 of the package 800 according to the third embodiment of the invention will now be described in detail with reference to FIG. 12.

As aforesaid, the right inner wall 312 and the left inner wall 316 of the sleeve comprise left and right holes 902. The holes 902, which are oblong, are each located at a position offset slightly towards the rear of the sleeve 900. The right outer wall 320 and the left outer wall 324 do not comprise holes and act as covers for the holes 902 when the sleeve is assembled. Specifically, by virtue of the fact that the right and left outer walls 320, 324 overlie the right and left inner walls 312, 316 in the assembled sleeve 900, the holes 902 in the right and left inner walls 312, 316 are covered by flexible covering sections 904 of the right and left outer walls 320, 324. The covering sections 904 are integral but demarcated by fold lines 905 (although this is not essential) and lie flush with the right and left outer walls 320, 324.

The assembly of the package 800 according to the third embodiment of the invention is essentially identical to that of the package 100 according to the first embodiment of the invention, save that the latch members 852, 854 of the storage tray 850 engage only the holes 902 in the inner side walls 312, 316, with the outer side walls 320, 324 acting as covers. The tab member 950 of the package 800 has the same structure as the tab member 400 of the package 100 according to the first embodiment of the invention.

To explain the identical structure of the tab member 950 and the identical aspects of the assembly of the package 800 according to the third embodiment of the invention without duplication, reference is simply made to relevant parts of the above description in respect of the first embodiment. Like reference numerals are used for like parts in FIG. 10A to 13B. The second bonding point 402, which is located on the second, away-facing side 306 of the sleeve 900 is shown in dashed lines in FIG. 12.

Figure 13A:
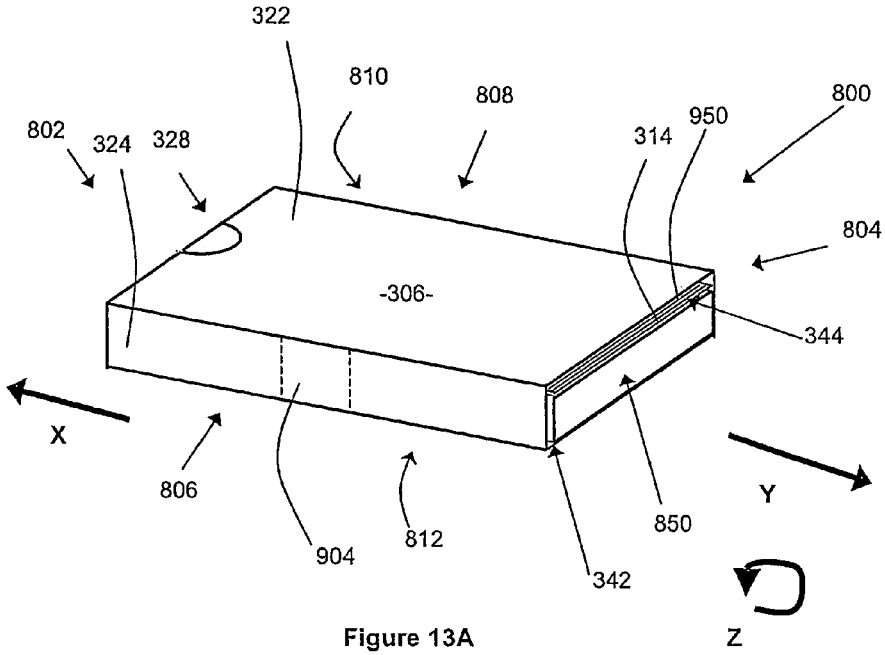
FIG. 13A is a perspective view of the package according to the third embodiment of the invention in a fully closed state.
Figure 13B:
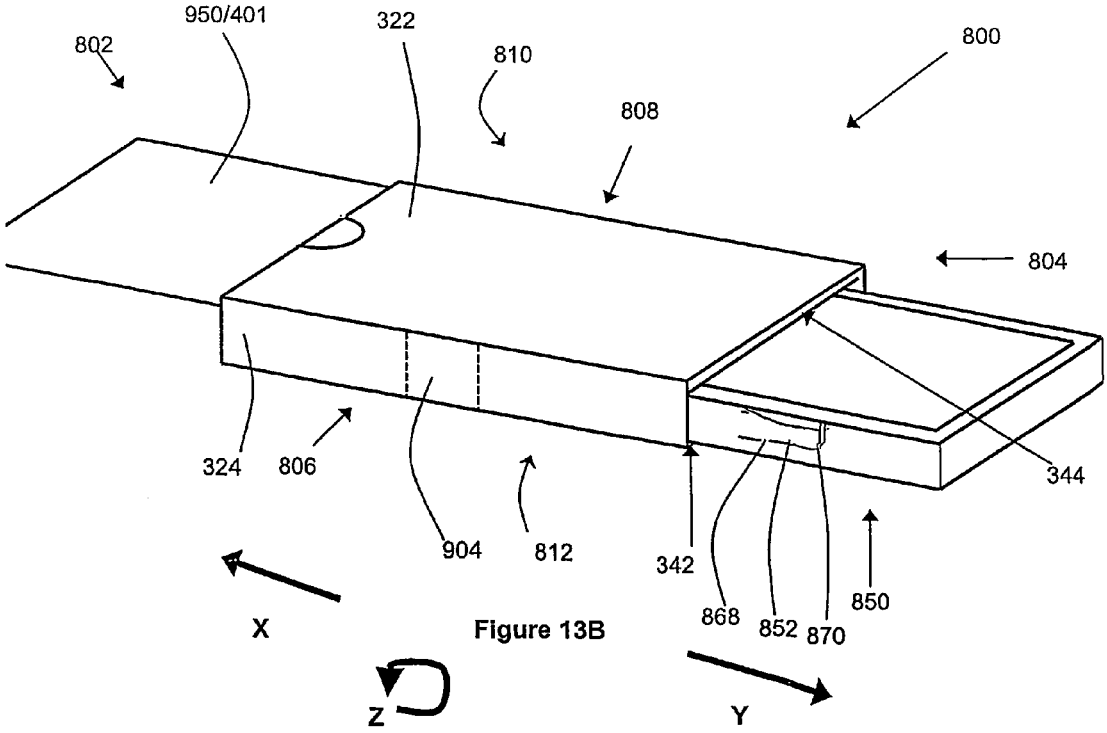
FIG. 13B is a perspective view of the package of FIG. 13A in a fully open state.

With reference to FIGS. 13A and 13B, in the assembled package 800 the storage tray 850 is housed within a lower passage 342 of the sleeve 900 whilst the tab member 950 is housed in an upper passage 344 of the sleeve 900. The divider 314 of the sleeve 900 separates the upper passage 344 and the lower passage 342.

The assembled package 800 can be brought from a fully closed state shown in FIG. 13A, in which the content of the storage tray 850 (e.g. a blister pack—not shown) is inaccessible, into a fully open state shown in FIG. 13B, in which the content of the storage tray 850 is accessible. To provide the desired child resistance, the latch members 852, 854 and the covering sections 904 (alone and in synergy with the belt 332 and divider 314 of the package 800) make it difficult for children to bring the package 800 from the fully closed state into the fully open state, as described below. Yet, adults find it easy to open the package 800 even if they are infirm or lack dexterity.

When the latch members 852, 854 are in the engaged state, their engagement formations 864, 866 engage the holes 902 of the right and left inner side walls 312, 316 of the sleeve 300, with the shoulders 870 facing the front end 804 of the package 800. Thus the shoulders 870 abut against respective front edges 906 of the holes 902, as illustrated schematically in FIG. 11A, to prevent movement of the storage tray 850 in the direction of arrow Y in FIGS. 13A and 13B. The covering sections 904 of the right and left outer walls 320, 324 conceal the latch members 852, 854 from users.

Movement of the storage tray 850 in direction Y can only occur when the latch members 852, 854 are simultaneously brought into their disengaged state by a user pressing the covering sections 904 of the outer walls 320, 324 towards each other, as illustrated in schematically in FIG. 11B, for example in a squeezing action between thumb and forefinger. Since the covering sections 904 of the outer walls 320, 324 are flexible, they cooperate with the latch members 852, 854 to force them into the disengaged state.

The belt 332 supported by the divider 314 links sliding movement of the storage tray 850 and the tab member 950 as described in our European patent number EP1140639.

Referring again to FIGS. 13A and 13B, provided that the left and right latch members 852, 854 have been moved into their disengaged states as a result of cooperation with the covering sections 904 as described above, the tab member 950 can be pulled in the direction of arrow X, aided by the indentations 328 in the upper wall 322 of the sleeve and the storage tray 850. The tab member 950 may thereby be moved from the fully closed state in direction X, causing the belt 332 to turn about the divider 314 in the direction of arrow Z, since the tab member 950 is secured to the belt 332 at the second bonding point 402.

The movement of the belt 332 causes the storage tray 850 to move in the direction of arrow Y, since the storage tray 850 is also attached to the belt 332 at the first bonding point 340 on the other side 304 of the divider 314. Once clear of the holes 902, the latch members 852, 854 are held inwards in the disengaged state by the side walls 312, 316, 320, 324 of the sleeve 900 (as illustrated in FIG. 11B) until they are clear of the sleeve 900 as a whole, whereupon they are biased back outwards by the live hinges 872, 874. When the first and second bonding points 340, 402 reach the edges of the divider at the front and rear ends 804, 802 of the package 800, the tab member 950 can be pulled no further in the direction of arrow X and the storage tray 850 can move no further in direction Y. The package 800 is then in the fully open state shown in FIG. 13B.

When the tab member 950 is moved back in the direction of arrow Y, the tab member 950 causes the belt 332 to turn about the divider 314 in a direction opposite to arrow Z, so that the storage tray 850 moves in the direction of arrow X. When the bonding points 340, 402 reach the opposite edges of the divider 314, further movement of the storage tray 850 in direction X is prevented and the package 800 is back in the fully closed state.

If preferred, a user can push the storage tray 850 in the direction of arrow X to close the storage tray 850, which in turn pulls the tab member 950 back into the sleeve 900. The effect is the same, in that both the storage tray 850 and the tab member 950 will return to the fully closed state shown in FIG. 13A, in which the storage tray 850 is inaccessibly housed within the sleeve 900.

When the storage tray 850 is returned into the sleeve 900 from the fully open state, the side walls 312, 316, 320, 324 of the sleeve 900 initially push the left and right latch members 852, 854 into the disengaged state. The ramps 868 of the latch members 852, 854 facilitate this inward movement, acting to guide the latch members 852, 854 into the disengaged state gradually, against the bias of the live hinges 872, 874. However, when the engagement formations 864, 866 of the latch members 852, 854 reach their associated hole 902 in the inner side walls 312, 316 they are moved into the engaged state due to the bias of the live hinges 872, 874. Thus the left and right latch members 864, 866 engage in a snap fit with the sleeve 900 when the storage tray 850 is returned fully into the sleeve 900 in direction X.

The covering sections 904 for concealing the latch members 852, 854 provide a first level of child resistance. To open the package 800, users must initially have an understanding that it is necessary to actuate the covering sections 904 to move the latch members 852, 854 into the disengaged state. This understanding is generally absent in children, particularly since the covering sections 904 are integral, and lie flush, with the outer left and right side walls 320, 324, concealing the latch members 852, 854 in their entirety.

To help address the paradox that a package which is difficult for a child to open often also presents difficulties for adults, the covering sections 904 may be marked, for example with letters, and written instructions may be supplied on how to disengage the latch members 852, 854, for example on the sleeve 900 of the package 800. Thus it is possible for the covering sections to conceal the latch members 852, 854 whilst still providing an indication of where the latch members are.

Additional child resistance is provided by a synergy between the tab member 950, the belt 332, the latch members 852, 854 and the covering sections 904. Even once a user has understood that it is necessary to press the covering sections 904 to open the package 800, the storage tray 850 cannot be opened via the covering sections 904 alone. Instead, to gain access to the storage tray 850, it is necessary to hold the left and right latch members 852, 854 in the disengaged state with one hand by pressing the covering sections 904 inwards, and, simultaneously, to apply an opening force on the tab member 950 at the opposite end of the package 800 with the other hand.

The force that is required to access the storage tray 850, by moving it in direction Y, is reversed by the belt 332, such that an opposite opening force, in direction X, must be applied to the tab member 950 at an opposite end 802 of the package 800 whilst the latch members 852, 854 are simultaneously disengaged. The need to understand the link between holding the latch members 852, 854 in their disengaged state (via the covering sections 904) and opposite movement of the tab member 950 with respect to the direction of movement of the storage tray 850, provides additional child resistance.

As is evident from the above description, in addition to linking the storage tray 850 and the tab member 950, the belt 332 surrounding the divider 312 delimits sliding movement of the storage tray 850 and the tab member 950. The first and second bonding points 340, 402 reach opposite edges of the divider 314 at the front and rear ends of the package 804, 802 in the fully open and fully closed states. As a result, the storage tray 850 is prevented from moving in direction Y in the fully open state. Similarly, the belt prevents the storage tray 850 from moving in direction X in the fully closed state.

Since, in the fully closed state, the latch members 852, 854 of the storage tray 850 additionally prevent movement of the storage tray 850 in direction Y, any hazardous materials held by the storage tray 850 remain inaccessible to children. The divider 314 and belt 332 act in synergy with the latch members 852, 854 to provide child resistance.

As aforesaid, the packages according to the specific embodiments described so far are only exemplary. Numerous modifications may be made within the scope of the invention as defined in the appended claims. To illustrate some exemplary modifications, two further embodiments of the invention will now be described.

Figure 14A:
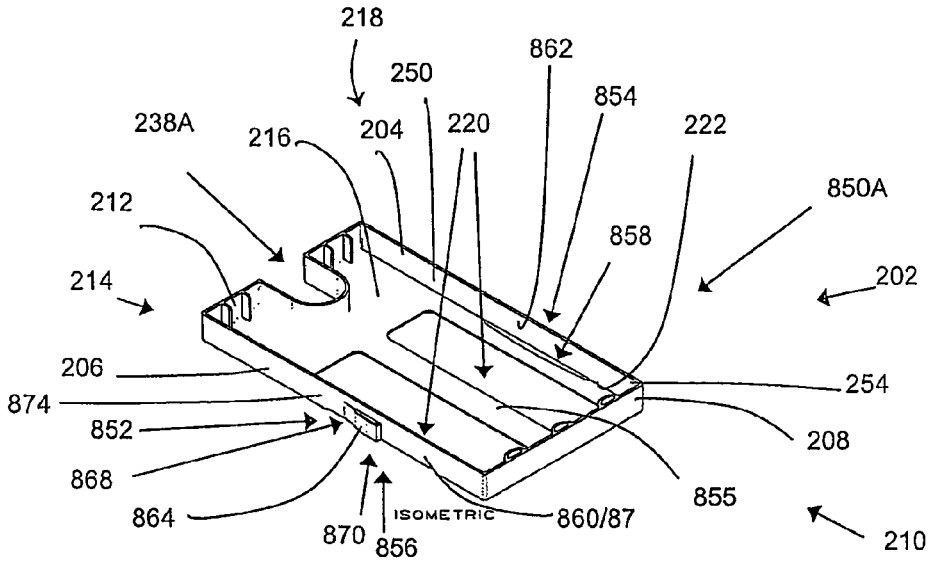
FIG. 14A is a perspective view of a frame of a storage tray of a package according to a fourth embodiment of the invention.
Figure 14B:
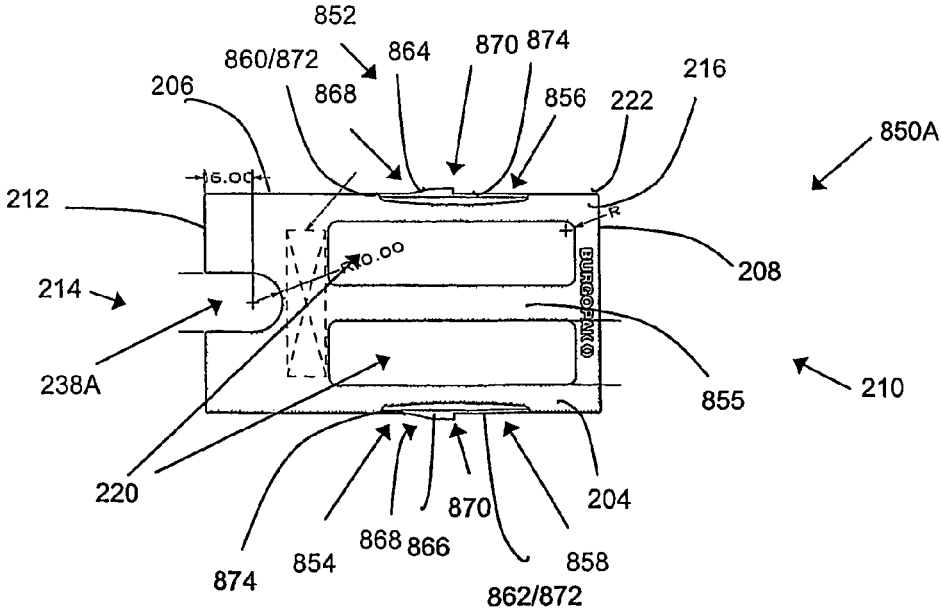
FIG. 14B is a plan view of the frame of FIG. 14A.
Figure 14C:
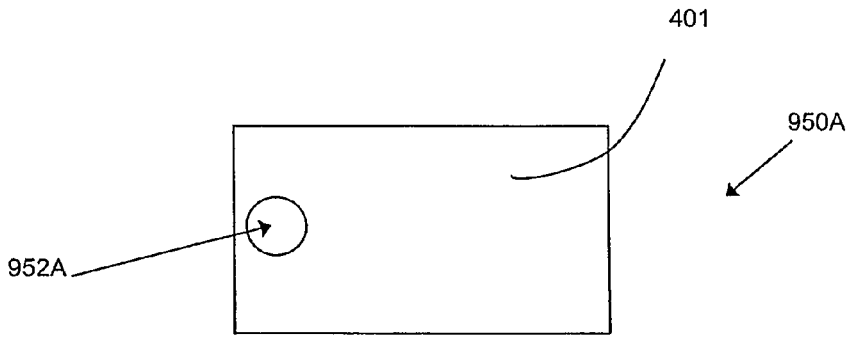
FIG. 14C is a plan view of a tab member of the package according to the fourth embodiment of the invention.

Referring to FIGS. 14A to 14C, in a fourth embodiment of the invention a child resistant package is identical in structure, assembly and operation to the package 800 according to the third embodiment of the invention, save for the specific modifications described below. Like reference numerals are used for like parts in FIGS. 14A to 14C.

The package according to the fourth embodiment of the invention comprises a modified storage tray 850A (shown without blister pack in FIGS. 14A and 14B), a modified tab member 950A (shown in FIG. 14C) and a modified sleeve (not shown).

The modified storage tray comprises an enlarged curved indentation 238A at its rear end 852A, which allows access to a finger hole 952A formed in the modified tab member 950A when the package is in its fully closed state. The modified sleeve comprises a similarly enlarged indentation in its upper wall to allow access to the finger hole 952A in the fully closed state.

The modified tab member 950A is easier to grip than a flat tab member on account of the finger hole 952A and thus works particularly well in combination with the belt, the latch members and the covering sections of the package to provide child resistance without compromising access for the elderly or infirm. The advantages described in respect of the third embodiment of the invention apply mutatis mutandis.

Figure 15A:
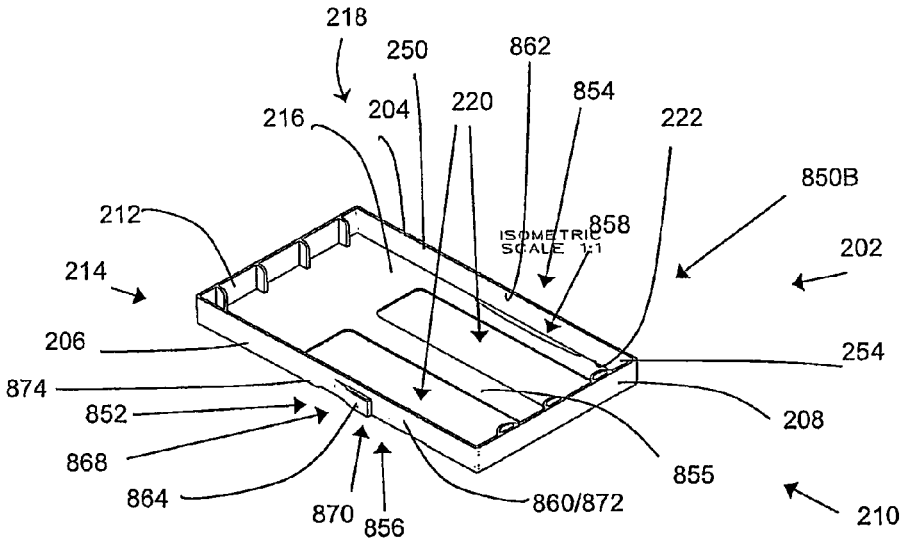
FIG. 15A is a perspective view of a frame of a storage tray of a package according to a fifth embodiment of the invention.
Figure 15B:
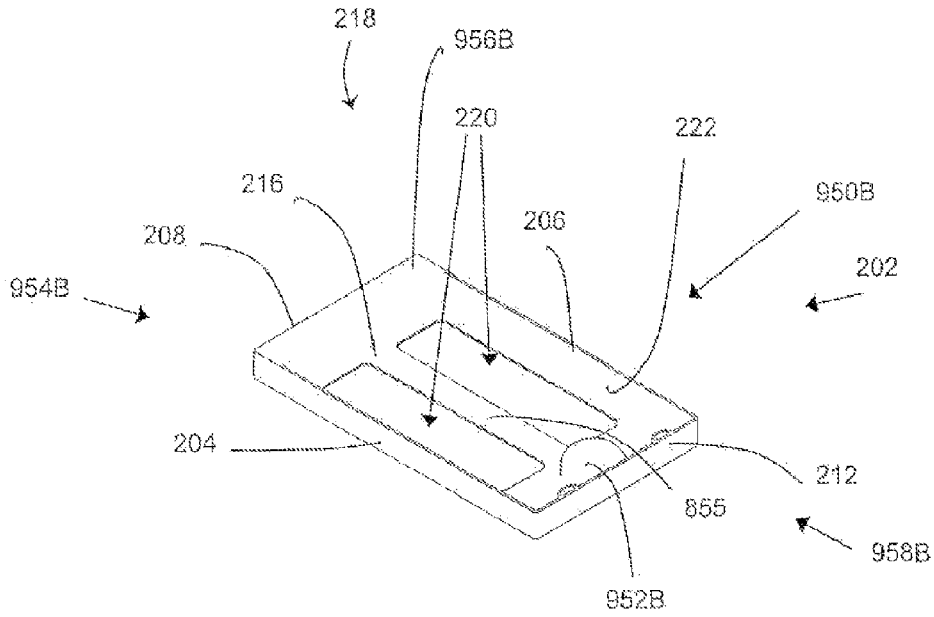
FIG. 15B is a perspective view of a frame of a tab member of the package according to the fifth embodiment of the invention.
Figure 15C:
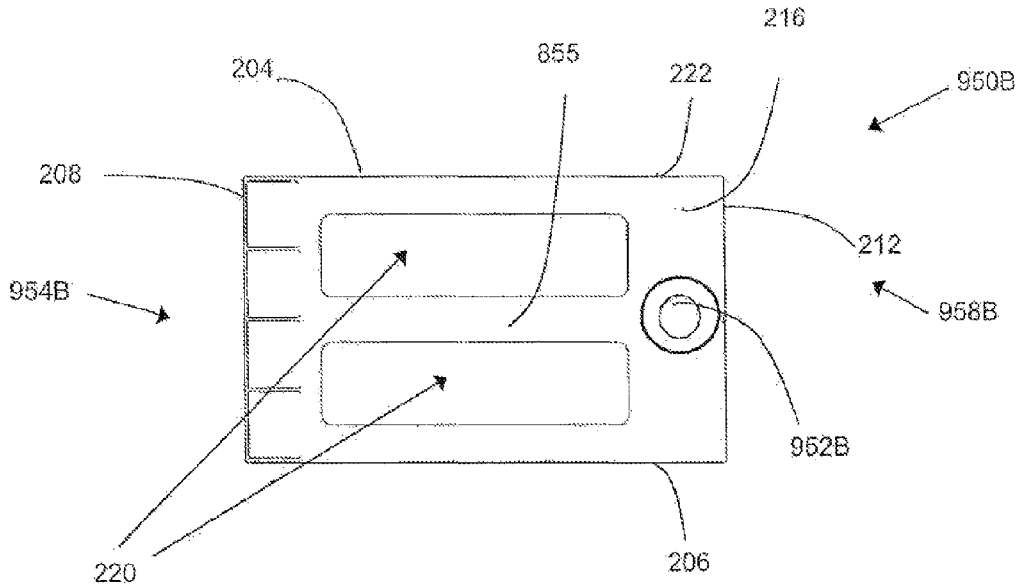
FIG. 15C is a plan view of the frame of FIG. 15B.

Referring to FIGS. 15A to 15C, in a fifth embodiment of the invention a child resistant package is identical in structure, assembly and operation to the package 800 according to the third embodiment of the invention, save for the specific modifications described below. Like reference numerals are used for like parts in FIGS. 15A to 15C.

The package according to the fifth embodiment of the invention comprises a modified storage tray 850B (shown in FIG. 15A without blister pack) and a modified tab member 950B (shown in FIGS. 15B and 15C), and a modified sleeve (not shown).

The modified tab member 950B acts as a support for a second blister pack (not shown in FIGS. 15B and 15C). Specifically, the modified tab member is identical in structure to the storage tray 850 of the third embodiment of the invention, save that the modified tab member 950B does not comprise latch members, includes an upward facing finger-well 952B at its rear end 954B instead of a curved indentation, and comprises an extended support area 956B for attaching the belt 332 to the flange 216 near its front end 958B. To avoid duplication, like reference numerals based on the storage tray 850 of the package 800 according to the third embodiment of the invention are used for like parts of the modified tab member 950B in FIGS. 15B and 15C, and reference is made to relevant parts of the description above.

The modified storage tray 850B is identical to the storage tray 850 of the third embodiment of the invention, save that the modified storage tray 850B does not comprise a curved indentation at its rear end 852B. A curved indentation is rendered unnecessary by the fact that the finger-well 9526 of the modified tab member faces upwards in the assembled package and is hence not accessed from below.

The modified sleeve of the package according to the fifth embodiment of the invention accommodates the modified tab member 950B by virtue of broader right and left outer side walls which define a deeper upper passage 344.

The package according to the fifth embodiment of the invention advantageously doubles the available storage space for hazardous material whilst still offering a high level of child resistance. Additionally, the advantages described in respect of the third embodiment of the invention apply mutatis mutandis.

The components of the various exemplary embodiments of the invention described above may be interchanged without departing from the scope of the invention as defined in the appended claims. For example, the central position of the latch members is not necessarily linked to the provision of covers. It is possible to provide latch members of the type described in respect of the third to fifth embodiments in the offset position described in the first or second embodiment.

Similarly, the package of the second embodiment, in which the latch members are supported by a barrier member, could be modified to include concealing covers of the type described in respect of the third to fifth embodiments. Further, the tab member of the first, second, third or fourth embodiments may be modified to act as a support as described above in respect of the fifth embodiment of the invention.

Indeed it is even possible for the latch members, or one or more additional latch members to be supported by the tab member, independently of whether or not the tab member supports a blister pack.

The invention claimed is:

1. A child-resistant package, comprising:

a support comprising a blister pack;

a structure for selectively blocking access to the blister pack, the support being movable in a first direction with respect to the structure between a secured position in which access to the blister pack is blocked by the structure and an access position in which the blister pack is accessibly clear of the structure;

at least one latch member movable by a user between an engaged state in which the support is prevented from moving out of the secured position and a disengaged state in which the support is allowed to move out of the secured position toward the access position, the at least one latch member adapted to be movable from the engaged state into the disengaged state by a single hand of a user to allow movement of the support towards the access position; and a tab member movable by the user with respect to the structure in a second direction different to the first direction, the tab member being coupled to the support to effect movement of the support out of the secured position in the first direction when the at least one latch member is in the disengaged state;

wherein the tab member is coupled to the support by a belt member, the belt member extending around a divider of the structure;

in the engaged state the at least one latch member prevents movement of the support out of the secured position into the first direction; and the belt member and the divider prevent movement of the support out of the secured position in the second direction.

2. The package of claim 1, being adapted for two-handed operation by a user, wherein the tab member is movable by one hand of the user when the at least one latch member has been moved into the disengaged state by the user's other hand.

3. The package of claim 1, wherein the first and second directions are mutually opposed.

4. The package of claim 1, wherein the tab member is movable away from the structure to effect movement of the support away from the structure.

5. The package of claim 4, wherein the structure defines opposed sides and the tab member is movable away from one side of the structure to cause the support to move away from the opposite side of the structure.

6. The package of claim 1 comprising first and second latch members, each latch member being movable by a user between an engaged state in which the support is prevented from moving out of the secured position and a disengaged state in which the support is allowed to move out of the secured position toward the access position.

7. The package of claim 6, wherein the first and second latch members are adapted to be movable from their engaged state into their disengaged state in a squeezing action between thumb and forefinger of a user.

8. The package of claim 6, wherein the first and second latch members are integral with each other.

9. The package of claim 1, wherein the at least one latch member is to one side of the structure, opposed to a grip of the tab member.

10. The package of claim 1, wherein the at least one latch member is resiliently biased into the engaged state.

11. The package of claim 1, wherein the at least one latch member comprises a live hinge.

12. The package of claim 1 wherein the at least one latch member comprises a button formation shaped to be pressured by a finger of a user.

13. The package of claim 1, wherein the at least one latch member comprises a shoulder for engaging the structure of the package in the engaged state.

14. The package of claim 1 wherein the at least one latch member acts between the support and the structure.

15. The package of claim 14, wherein the at least one latch member is carried by the support.

16. The package of claim 15, wherein the at least one member protrudes beyond an outer wall of the support in the engaged state.

17. The package of claim 16, wherein, in the disengaged state, the at least one latch member lies substantially flush with the outer wall and is accommodated within the support.

18. The package of claim 15, wherein the at least one latch member comprises a spring arm that is integral with the support.

19. The package of claim 1, wherein the at least one latch member acts between the support and a barrier member that is movably or removably attached to the structure in the engaged state to block movement of the support into the access position.

20. The package of claim 19, wherein the at least one latch member is carried by the barrier member.

21. The package of claim 19, wherein the at least one latch member is arranged such that the barrier member is engagable in a snap fit with the structure.

22. The package of claim 20, wherein the at least one latch member protrudes beyond a central panel of the barrier member in the engaged state.

23. The package of claim 22, wherein the central panel defines the maximum width of the barrier member when the at least one latch member is in the disengaged state.

24. The package of claim 1 wherein the tab member comprises a storage means.

25. The package of claim 1, wherein the tab member comprises a grip formation.

26. The package of claim 1, wherein the support comprises a storage tray supporting the blister pack.

27. The package of claim 1, wherein the at least one latch member is integrally molded with the support.

* * * * *

UNITED STATES PATENT AND TRADEMARK OFFICE

CERTIFICATE OF CORRECTION

PATENT NO. : 8,453,840 B2
APPLICATION NO. : 12/673829
DATED : June 4, 2013
INVENTOR(S) : Burgo John Wharton It is certified that error appears in the above-identified patent and that said Letters Patent is hereby corrected as shown below:

In the Claims

Col. 22, Claim 16, Lines 22-23, "the at least one member" should read --the at least one latch member--.

Signed and Sealed this
Thirty-first Day of December, 2013

Margaret A. Focarino

Margaret A. Focarino
*Commissioner for Patents of the United States Patent and Trademark Office*